US012108795B2

(12) United States Patent
Okazaki et al.

(10) Patent No.: US 12,108,795 B2
(45) Date of Patent: Oct. 8, 2024

(54) ATOMIZATION DEVICE, ATOMIZATION DEVICE ASSEMBLY, AND CONTROL SYSTEM OF ATOMIZATION DEVICE

(71) Applicant: FUNAI ELECTRIC CO., LTD., Osaka (JP)

(72) Inventors: Nobuyuki Okazaki, Osaka (JP); Aiichiro Ikeda, Osaka (JP); Fuminori Tanaka, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 379 days.

(21) Appl. No.: 17/688,924

(22) Filed: Mar. 8, 2022

(65) Prior Publication Data

US 2022/0295890 A1 Sep. 22, 2022

Related U.S. Application Data

(60) Provisional application No. 63/164,515, filed on Mar. 22, 2021.

(51) Int. Cl.

| | |
|---|---|
| ***A24F 40/46*** | (2020.01) |
| ***A24F 40/42*** | (2020.01) |
| ***A24F 40/48*** | (2020.01) |
| ***A24F 40/53*** | (2020.01) |

(52) U.S. Cl.

CPC ..... *A24F 40/46* (2020.01); *A24F 40/42* (2020.01); *A24F 40/48* (2020.01); *A24F 40/53* (2020.01)

(58) Field of Classification Search

None

See application file for complete search history.

(56) References Cited

U.S. PATENT DOCUMENTS

| | | | | |
|---|---|---|---|---|
| 8,540,169 | B2 * | 9/2013 | Kambayashi | B05B 17/0646 239/102.1 |
| 9,415,412 | B2 | 8/2016 | Kawashima et al. | |
| 2003/0218077 | A1 | 11/2003 | Boticki et al. | |
| 2004/0200907 | A1 | 10/2004 | Martens et al. | |
| 2008/0142617 | A1 | 6/2008 | Kasuya et al. | |
| 2014/0367486 | A1 | 12/2014 | Kawano et al. | |

(Continued)

FOREIGN PATENT DOCUMENTS

| | | |
|---|---|---|
| EP | 2047914 | 4/2009 |
| EP | 2820949 | 1/2015 |

(Continued)

*Primary Examiner* — Oscar C Jimenez
(74) *Attorney, Agent, or Firm* — JCIPRNET

(57) ABSTRACT

An atomization device, an atomization device assembly, and a control system therefor capable of stably spraying are provided.

An atomization device of the disclosure includes: a main body that has a vibrating device and a cavity part and in which the vibrating device is disposed above the cavity part and includes a vibrating element; and a tank assembly that is detachably provided with respect to the main body and is accommodated in the cavity part in a coupled state attached to the main body, wherein the tank assembly includes a liquid supply tank that has a space to hold a liquid, and a liquid supply core that supplies the liquid in the liquid supply tank to one side of the vibrating device, and wherein the atomization device further includes a relay absorber that is installed between the vibrating element and the liquid supply core.

19 Claims, 21 Drawing Sheets

(56) References Cited

U.S. PATENT DOCUMENTS

| | | | | |
|---|---|---|---|---|
| 2017/0274405 | A1 | 9/2017 | Lucas et al. | |
| 2018/0343924 | A1* | 12/2018 | Lin | F16K 31/004 |
| 2021/0112881 | A1* | 4/2021 | Hejazi | B05B 17/0676 |
| 2021/0260312 | A1* | 8/2021 | Lacour-Gayet | B05B 17/0646 |

FOREIGN PATENT DOCUMENTS

| | | |
|---|---|---|
| JP | 5981194 | 8/2016 |
| WO | 2014104457 | 7/2014 |
| WO | 2015175527 | 11/2015 |

* cited by examiner

ATOMIZATION DEVICE, ATOMIZATION DEVICE ASSEMBLY, AND CONTROL SYSTEM OF ATOMIZATION DEVICE

CROSS-REFERENCE TO RELATED APPLICATION

This application claims the priority benefit of U.S. provisional Application No. 63/164,515, filed on Mar. 22, 2021. The entirety of the above-mentioned patent application is hereby incorporated by reference herein and made a part of this specification.

BACKGROUND

Technical Field

The disclosure relates to an atomization device, an atomization device assembly, and a control system of atomization device.

Description of Related Art

As an atomization device, there are the following atomization devices.

Since mist is blown upward, a vibrating device is usually attached to an upper surface of a main body of an atomization device, and a water absorption core is widely used as a structure for supplying water from a tank to a vibrating element. In the related art as in Patent Document 1, a sprayer transfers a liquid in a tank to an ultrasonic vibrating element through a water absorption core and atomizes the liquid with a vibration of the vibrating device. In such related art, the amount of water transferred to the vibrating device changes due to a gap between the vibrating device and the water absorption core, or changes due to a change in a contact state between the vibrating device and the water absorption core. Therefore, in the above-mentioned related art, there are the following technical problems to be improved. (1) Decrease in spray efficiency and insufficient spray amount. (2) In a process of spraying, there may be situations where the spray becomes unstable and the spray becomes non-uniform.

PATENT DOCUMENTS

[Patent Document 1] Japanese Patent No. 5981194

The disclosure provides an atomization device in which a specific relay absorber is provided between two members of a vibrating device and a liquid supply core to solve the problems in an atomization device of the related art such as decrease in spray efficiency, instability, and non-uniform spray.

SUMMARY

According to an embodiment of the disclosure, there is provided an atomization device including: a main body that has a vibrating device and a cavity part and in which the vibrating device is disposed above the cavity part and includes a vibrating element; and a tank assembly that is detachably provided with respect to the main body and is accommodated in the cavity part in a coupled state of being attached to the main body, wherein the tank assembly includes a liquid supply tank that has a space to hold a liquid, and a liquid supply core that supplies the liquid in the liquid supply tank to one side of the vibrating device, and wherein the atomization device further includes a relay absorber that is installed between the vibrating element and the liquid supply core.

According to the embodiment of the disclosure, the vibrating element includes a mesh plate located in a central portion and a piezoelectric element located in a peripheral portion, the mesh plate has a dome part at a center of the vibrating element, and a part of the relay absorber is disposed in the dome part of the mesh plate.

According to the embodiment of the disclosure, the relay absorber has a cut-out portion, and a part of the cut-out portion communicates with the inside of the dome part of the mesh plate.

According to the embodiment of the disclosure, the cut-out portion includes a radial slit, and at least a part of the radial slit overlaps the dome part in an orthographic projection direction.

According to the embodiment of the disclosure, single one radial slit is provided, and a length of the radial slit is larger than a radius of the relay absorber.

According to the embodiment of the disclosure, a plurality of the radial slits are provided, and the plurality of radial slits are radial in an orthographic projection direction of the relay absorber.

According to the embodiment of the disclosure, the cut-out portion includes a plurality of parallel slits, and in an orthographic projection direction of the relay absorber, the plurality of parallel slits are disposed in a staggered pattern to be point-symmetrical with respect to a center of a circle of the relay absorber.

According to the embodiment of the disclosure, the relay absorber includes a protrusion located at a center and a peripheral flat portion located around the protrusion, a thickness of the protrusion is thicker than that of the peripheral flat portion, and the protrusion is disposed within the dome part.

According to the embodiment of the disclosure, the relay absorber has a cut-out portion, and a part of the cut-out portion communicates with the dome part of the mesh plate, and a length of the cut-out portion is a sum of a length of the peripheral flat portion and a diameter of the protrusion.

According to the embodiment of the disclosure, the liquid supply core has a liquid absorbing end and an atomizing end, and a diameter of the atomizing end of the liquid supply core is smaller than an outer diameter of a portion of the liquid supply core other than the atomizing end.

According to the embodiment of the disclosure, the atomizing end of the liquid supply core has a spherical shape.

According to the embodiment of the disclosure, the vibrating device further includes an upper lid, a base, and an internal pressure adjusting sheet installed between the upper lid and the base, and the vibrating element is installed between the upper lid and the base, and the liquid is atomized by the vibrating element. According to the embodiment of the disclosure, each of the upper lid and the base has an upper through hole and a lower through hole, and the upper through hole and the lower through hole communicate with an outside air. According to the embodiment of the disclosure, the vibrating device further includes a plurality of sealing members disposed between the vibrating element and the upper lid and between the vibrating element and the base.

According to the embodiment of the disclosure, the tank assembly further includes a support rod, the support rod is installed in the liquid supply tank, and in the coupled state, the support rod is connected to the vibrating device, and the liquid supply core has a liquid absorbing end and an atomizing end and the relay absorber is disposed between the vibrating element and the atomizing end of the liquid supply core.

According to the embodiment of the disclosure, the tank assembly further includes a sealing member disposed between the support rod and the liquid supply tank.

According to the embodiment of the disclosure, the support rod includes a connection upper part that is connected to the vibrating device, and a pipe part that accommodates the liquid supply core, and the connection upper part has a first through hole, the pipe part has a second through hole in a side wall of the pipe part, and the first through hole and the second through hole communicate with an outside air.

According to the embodiment of the disclosure, a material of the relay absorber consists of polyurethane.

According to the embodiment of the disclosure, the main body includes a case and a lid locking mechanism disposed on the case, and the lid locking mechanism is provided to be movable with respect to the case and has a closed state where an ejection port of the vibrating device is closed and an open state where the ejection port of the vibrating device is exposed.

According to another embodiment of the disclosure, there is provided an atomization device assembly including: the atomization device described above; and a waterproof case, wherein the atomization device is disposed in the waterproof case.

According to still another embodiment of the disclosure, there is provided a control system for an atomization device for controlling the atomization device described above, the control system including: a micro controller unit that controls the vibrating device of the atomization device and atomizes the liquid flowing from the liquid supply core to the relay absorber with a vibration of the vibrating element; and a driver circuit that monitors a drive voltage and a drive current of the piezoelectric element, wherein the driver circuit detects a change in impedance of the piezoelectric element on the basis of the drive voltage and the drive current and feeds back the change to the micro controller unit.

DESCRIPTION OF THE EMBODIMENTS

Figure 1A:
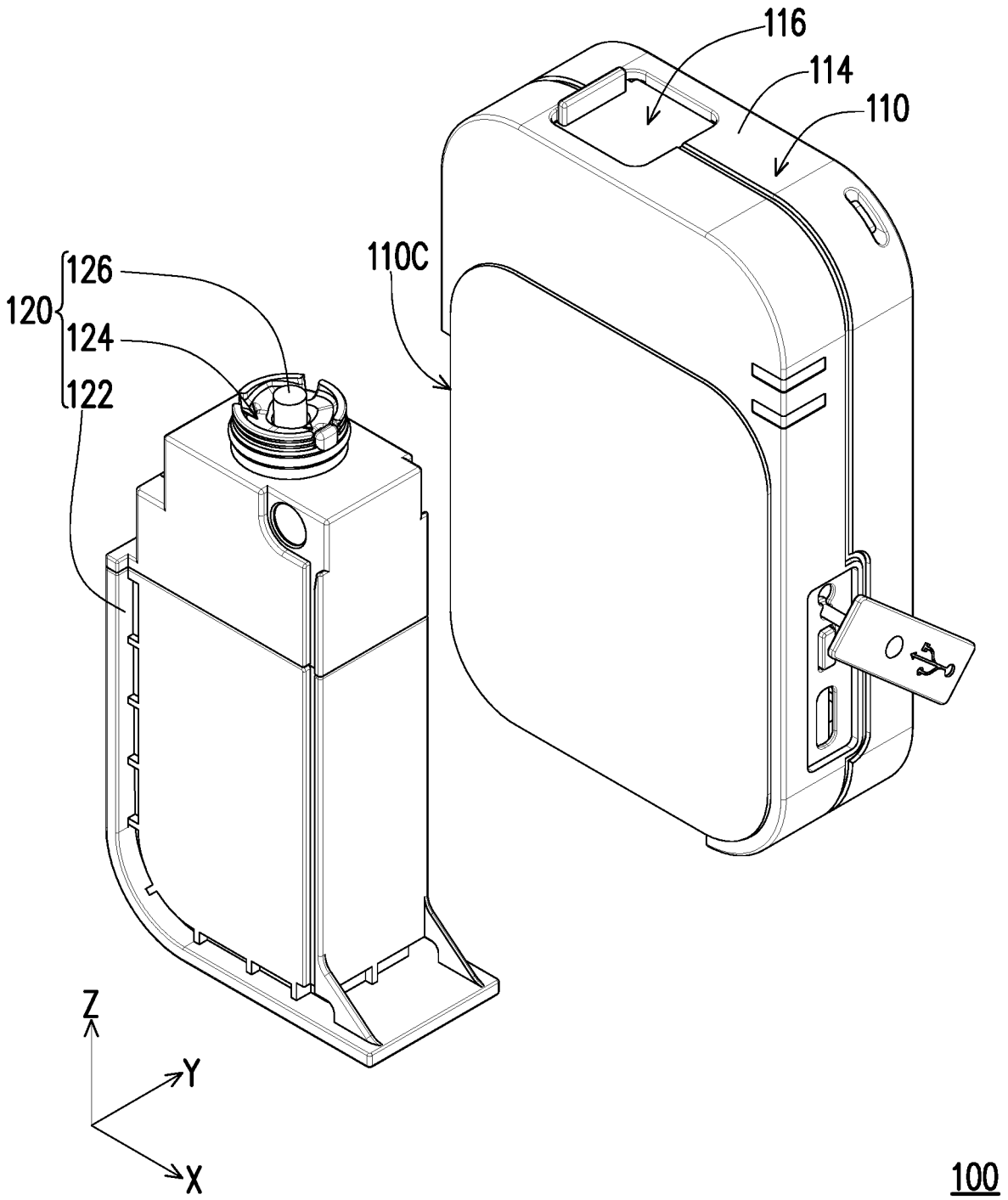
FIG. 1A is an exploded explanatory view and an external explanatory view of an atomization device according to an embodiment of the disclosure.

According to the atomization device of the disclosure, both stable spraying and increase in spray amount can be realized. In the embodiment, the specific structure that can be appropriately exhausted can reduce or eliminate the decrease in spray efficiency due to the air bubbles and further increase the usage rate of the liquid. In the embodiment, the specific waterproof structure can further provide waterproof performance. According to the atomization device assembly of the disclosure, it is possible to avoid a situation in which the water seeps out, leaks, or scatters in the atomization device. According to the control system for an atomization device of the disclosure, it is possible to accurately determine whether the water supply state is preferable and to cause the user to perform an appropriate operation in real time and accurately.

Here, exemplary embodiments of the disclosure are referred to in detail, and examples of the exemplary embodiments are shown in the drawings. Whenever possible, the same members are used in the drawings and description to indicate the same or similar members.

Figure 1B:
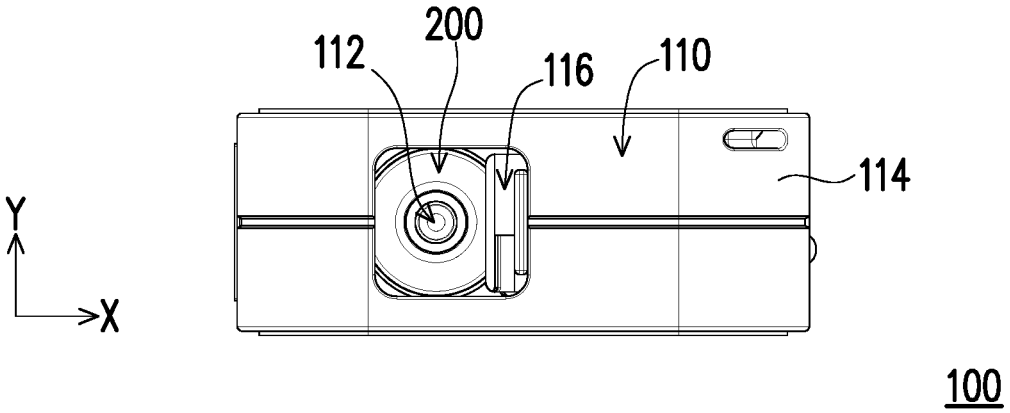
FIG. 1B is a top view of FIG. 1A.

FIG. 1A is an exploded explanatory view of the atomization device according to an embodiment of the disclosure, and X, Y, and Z directions indicate a width direction, a thickness direction, and a height direction in the atomization device. FIG. 1B is a top view of FIG. 1A, and FIG. 1C is a side view of FIG. 1A in a coupled state in the width direction X.

Figure 1C:
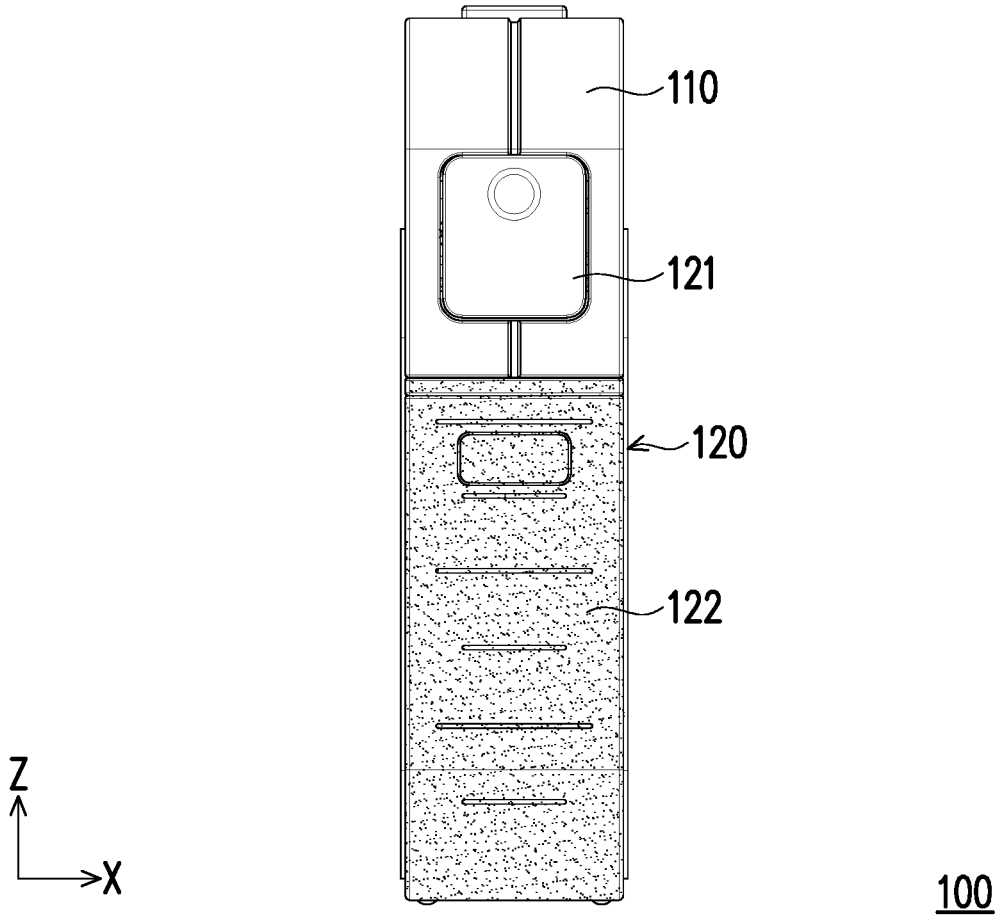
FIG. 1C is a side view of a coupled state in a width direction X of FIG. 1A.

With reference to FIGS. 1A to 1C, the atomization device 100 includes a main body 110 and a tank assembly 120, the main body 110 has a cavity part 110C, and the tank assembly 120 is detachably provided with respect to the main body 110. In the present embodiment, the tank assembly 120 slides with respect to the main body 110, for example, in the Z direction, but the disclosure is not limited thereto. In the coupled state of the main body 110 and the tank assembly 120, the tank assembly 120 can be accommodated in the cavity part 110C. The tank assembly 120 includes a liquid supply tank 122 and a liquid supply core 126 and further includes a support rod 124 in the present embodiment, but the disclosure is not limited thereto, and in another embodiment, the atomization device of the disclosure may be an embodiment that does not include the support rod 124, and for example, the liquid supply core 126 may be directly inserted into a bracket of a vibrating element. As shown in FIGS. 1A and 1B in the present embodiment, a liquid in the liquid supply tank 122 is supplied to the vibrating device 200 via the liquid supply core 126, is atomized with a vibration of the vibrating device 200 such as an ultrasonic vibration, and is sprayed from an ejection port 112 of the main body 110. As shown in FIG. 1C, in the coupled state, the tank assembly 120 is locked to the main body 110 with a locking member 121, and a user can remove the tank assembly 120 from the main body 110 by pushing the locking member 121.

Further, as shown in FIGS. 1A and 1B, the main body 110 can include a case 114 and a lid locking mechanism 116 disposed on the case 114, and the lid locking mechanism 116 can be detachably provided with respect to the case 114. Specifically, the lid locking mechanism 116 has a closed state where the ejection port 112 of the vibrating device 200 is covered and an open state where the ejection port 112 of the vibrating device 200 is exposed. As shown in FIG. 1A, in a state where the atomization device 100 is not in use, the lid locking mechanism 116 is in a closed state and protects the ejection port 112 of the vibrating device 200 from being affected by the external environment. On the other hand, as shown in FIG. 1B, in a use state, the user can open the lid locking mechanism 116 by simply pushing the lid locking mechanism 116 to move the lid locking mechanism 116 with respect to the case 114 and to expose the ejection port 112 of the vibrating device 200. In this way, the atomization device 100 of the embodiment can maintain the quality of the device via the lid locking mechanism 116 and reduce dirt and damage in a carrying process.

Figure 2:
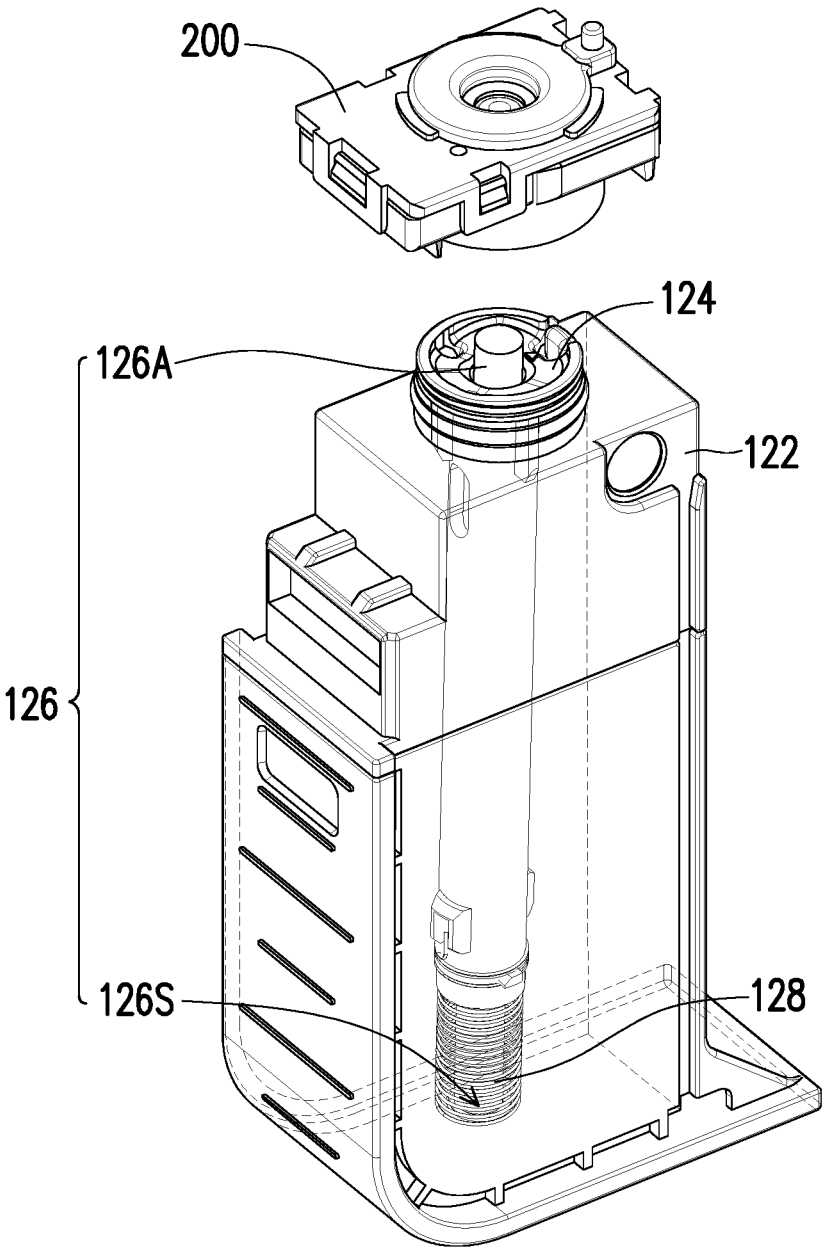
FIG. 2 is a structural explanatory view of a tank assembly and a vibrating device in the atomization device according to the embodiment of the disclosure.

FIG. 2 is a structural explanatory view of a tank assembly and a vibrating device in the atomization device according to the embodiment of the disclosure. With reference to FIG. 2, the vibrating device 200 is disposed above the cavity part 110C of the main body 110 as shown in FIG. 1A, the liquid supply core 126 is installed through the inside of the support rod 124, the liquid supply core 126 has a liquid absorbing end 126S and an atomizing end 126A, and the atomizing end 126A is disposed adjacent to one side of the vibrating device 200. In a coupled state of the main body and the tank assembly, the support rod 124 of the tank assembly 120 and the atomizing end 126A of the liquid supply core 126 are in contact with the vibrating device 200.

Figure 3:
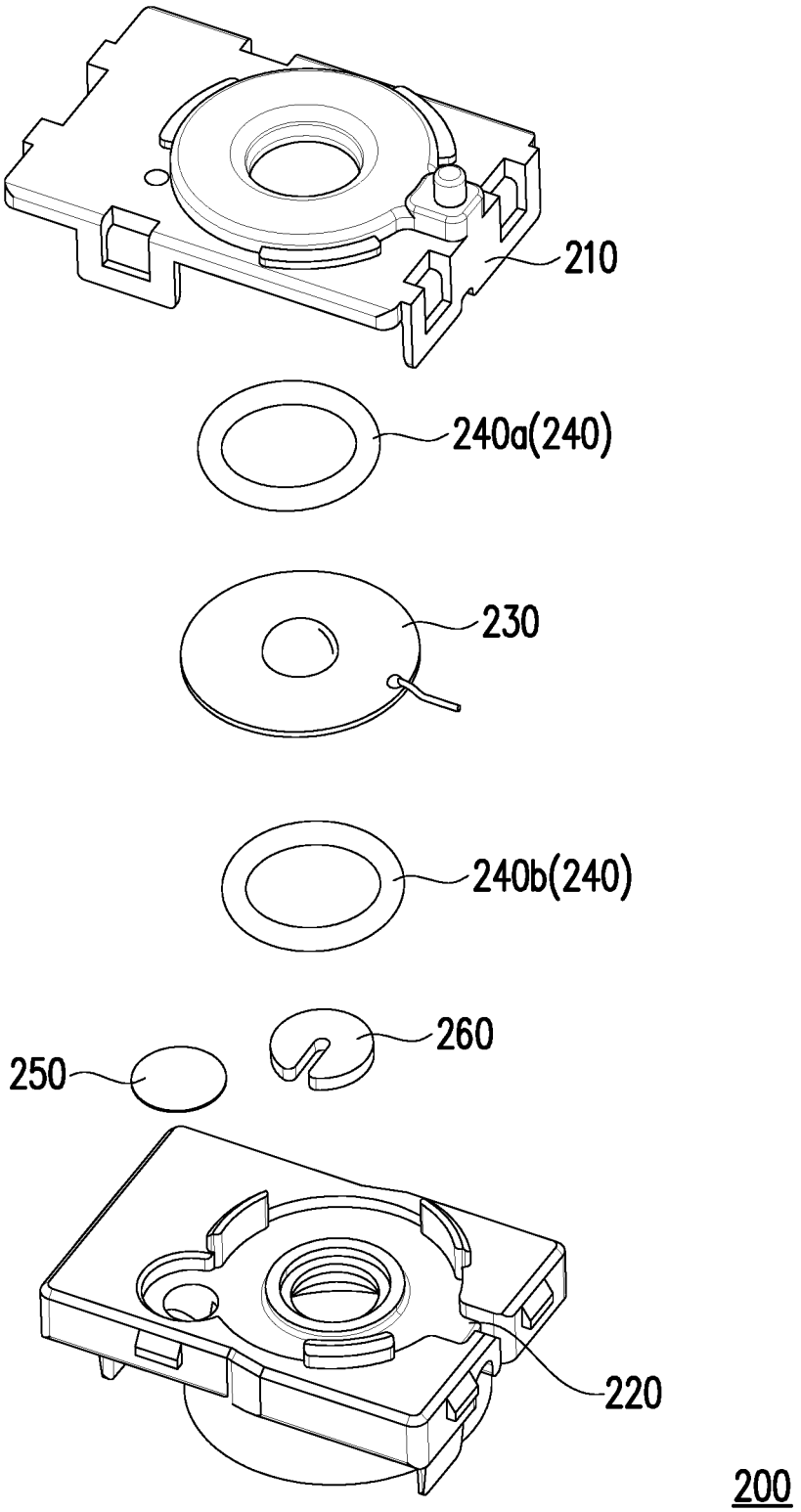
FIG. 3 is an exploded explanatory view of a vibrating device according to an embodiment of the disclosure.

FIG. 3 is an exploded explanatory view of a vibrating device according to an embodiment of the disclosure. With reference to FIG. 3, the vibrating device 200 can include an upper lid 210, a base 220, a vibrating element 230 disposed between the upper lid 210 and the base 220, and an internal pressure adjusting sheet 250. The internal pressure adjusting sheet 250 allows a pressure to be adjusted in the liquid supply tank 122 in FIG. 2, and the details of the pressure adjusting mechanism will be described later.

It should be noted that in the atomization device of the disclosure, a relay absorber 260 is provided between the vibrating element 230 and the base 220, and thus a function to fill a gap between the vibrating element 230 and the liquid supply core 126 can be provided by the relay absorber 260. Therefore, a change in the gap between the vibrating element 230 and the liquid supply core 126 and a change in the contact state can be reduced, whereby the spray amount and the spray efficiency can be stabilized. In the present embodiment, the relay absorber 260 is removably attached to the vibrating device 200.

Figure 4:
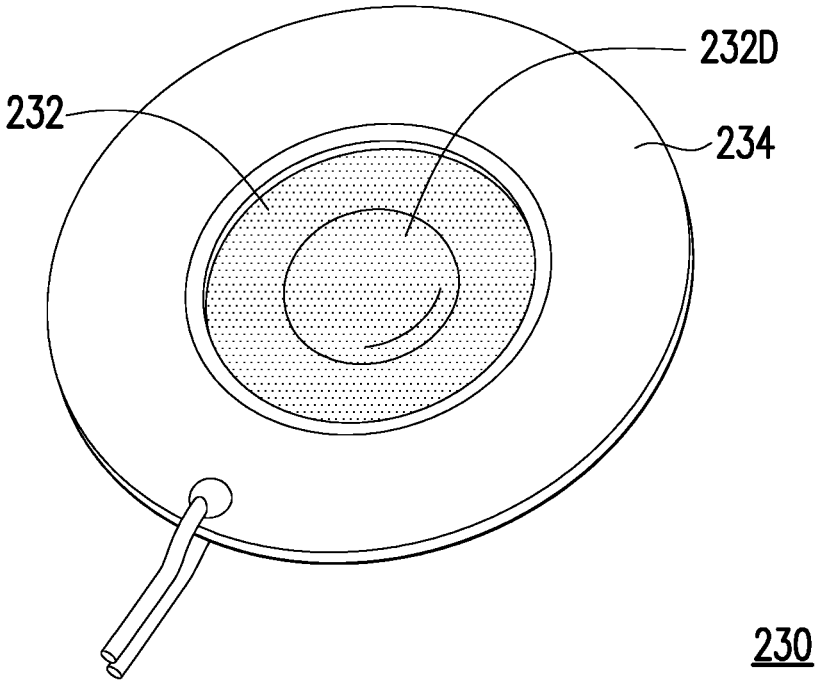
FIG. 4 is a structural view of a vibrating element according to an embodiment of the disclosure.

Further, as shown in FIG. 3, the vibrating device 200 of the present embodiment further includes a sealing member 240 and thus can further have waterproof performance while maintaining the spray efficiency. More specifically, as shown in FIG. 3, a sealing member 240*a* can be further provided between the vibrating element 230 and the upper lid 210, and a sealing member 240*b* can be further provided between the vibrating element 230 and the base 220. The vibrating element 230 is sandwiched between the upper lid 210 and the base 220 with the sealing member 240*a* and the sealing member 240*b*. When the vibrating element 230 is driven, it vibrates up and down to atomize the liquid. The following examples can be given as a configuration of the vibrating element 230. FIG. 4 is a structural view of a vibrating element according to an embodiment of the disclosure. As shown in FIG. 4, the vibrating element 230 can include a mesh plate 232 located in a central portion and a piezoelectric element 234 located at a periphery. As shown in FIG. 4, the mesh plate 232 has a dome part 232D at a center of the vibrating element 230. The dome portion 232D has a plurality of mesh-shaped micropores. In the present embodiment, the number of micropores in the dome part 232D is, for example, 500, and the size of each of the micropores is, for example, 5 μm in hole diameter.

As described above, from FIGS. 2 to 4, it was possible to clearly understand the specific structures and relative positional relationships of the liquid supply core, the relay absorber, and the vibrating element of the atomization device of the disclosure. In the following, a related mechanism for stabilizing the spray in the atomization device of the disclosure will be described.

Figure 5:
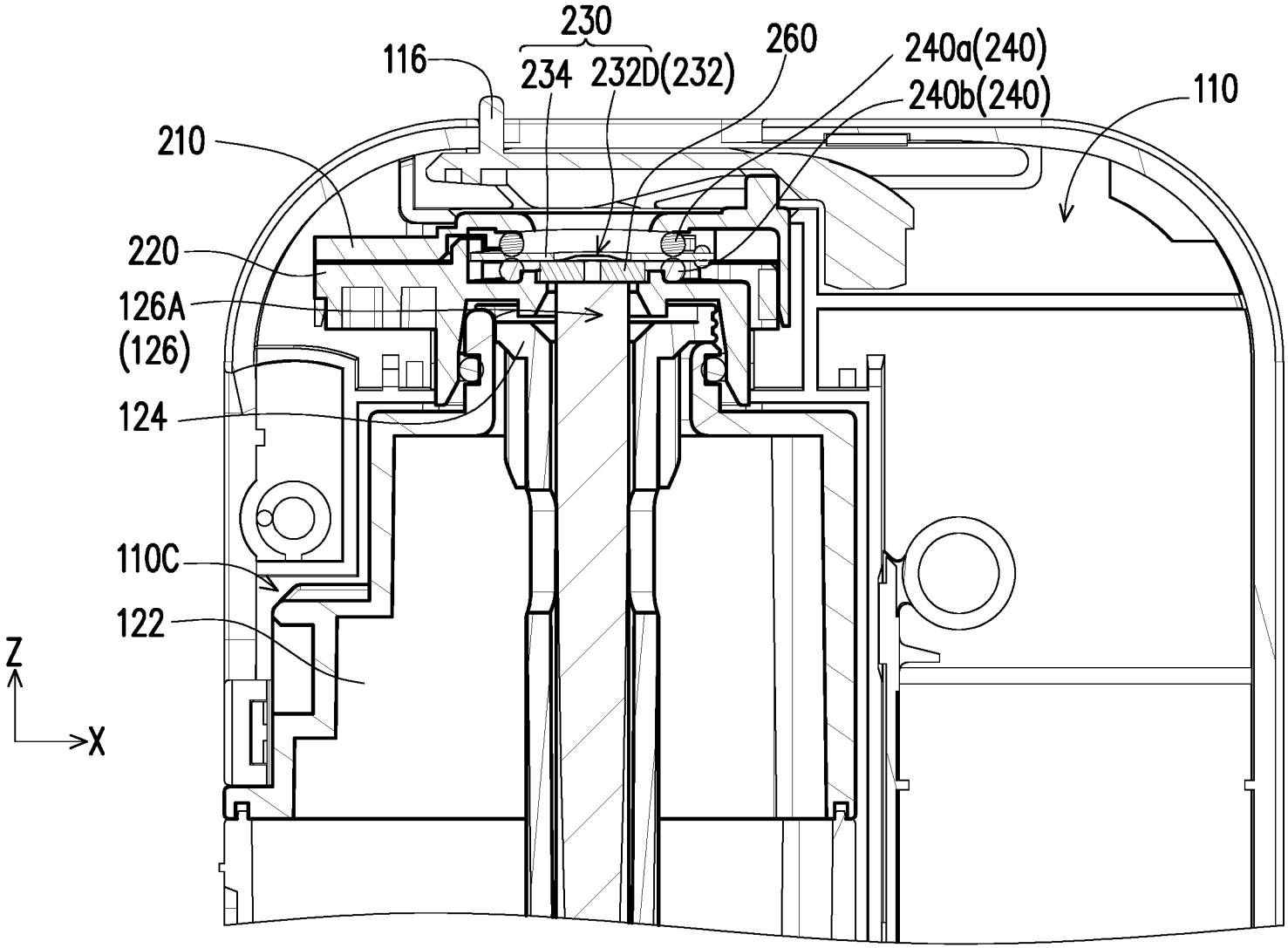
FIG. 5 is an enlarged cross-sectional explanatory view of a contact portion between a liquid supply core and the vibrating device in a coupled state of the atomization device according to the embodiment of the disclosure.

FIG. 5 is an enlarged cross-sectional explanatory view of a contact portion between a liquid supply core and the vibrating device in a coupled state of the atomization device according to the embodiment of the disclosure. The same reference signs as those described above in FIG. 5 represent the same members, and the relative positional relationship between the above-mentioned members can be clearly understood from FIG. 5, and thus the description will not be repeated here. As shown in FIG. 5, the relay absorber 260 is disposed between the vibrating element 230 and the atomizing end 126A of the liquid supply core 126. The relay absorber 260 is removably installed in the vibrating device 200, and in the coupled state, the liquid supply core 126 passes through an opening located at the base 220 of the vibrating device 200 and comes into contact with the relay absorber 260 and the vibrating element 230 upwardly.

Therefore, the gap between the vibrating element 230 and the liquid supply core 126 is substantially filled with the relay absorber 260, and the liquid sucked up by the liquid supply core 126 is held in the relay absorber 260. As a result, stable spray and an increase in the spray amount can be combined.

Figure 6A:
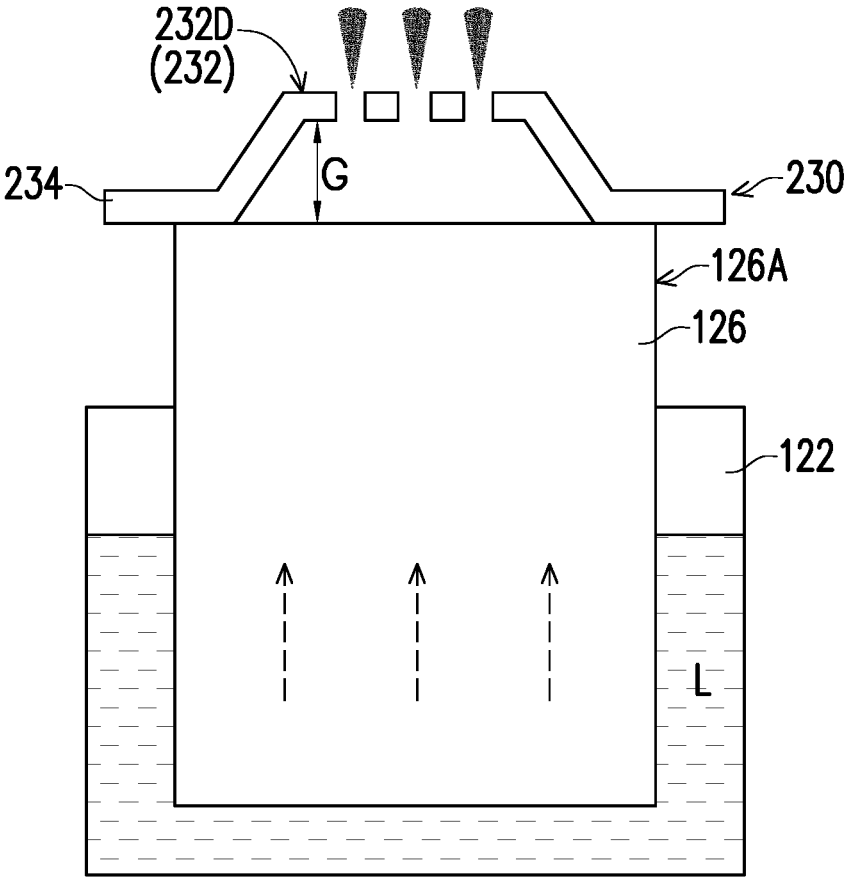
FIG. 6A is a cross-sectional explanatory view of an atomization device as a comparative example in which a relay absorber is not provided between the vibrating element and the liquid supply core.
Figure 6B:
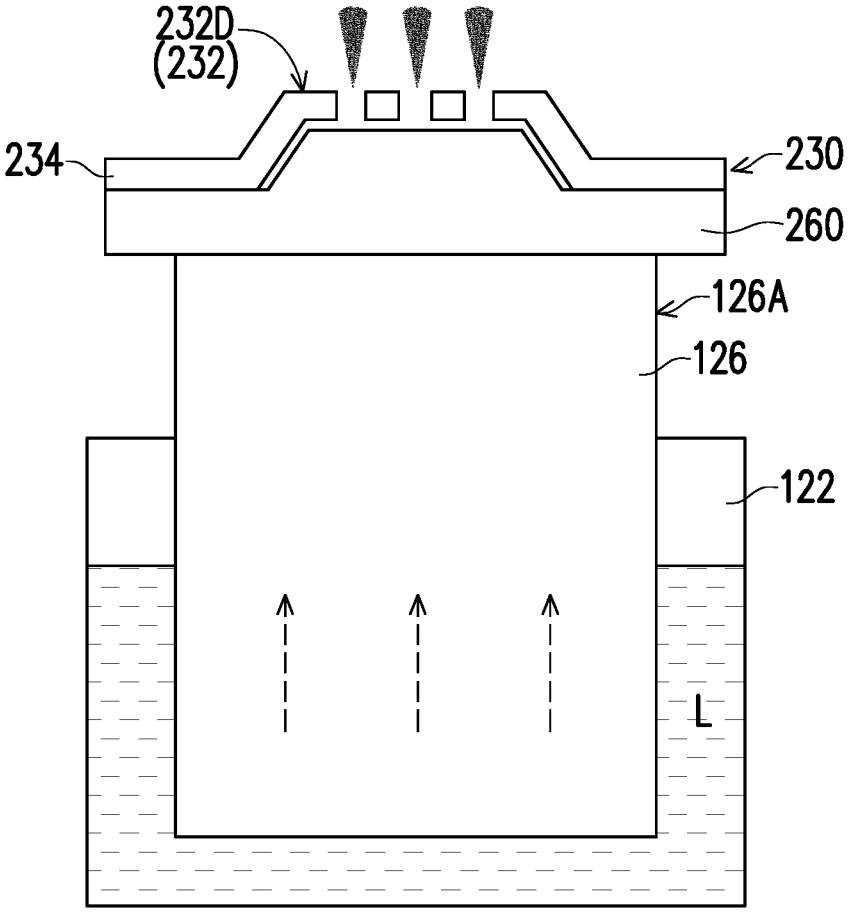
FIG. 6B is a cross-sectional explanatory view of the atomization device of the disclosure in which a relay absorber is added between the vibrating element and the liquid supply core.

In order to clearly explain the mechanism of the atomization device of the disclosure, a spray mechanism of the atomization device of the disclosure will be further described with reference to FIGS. 6A and 6B based on the structure of FIG. 5A. FIG. 6A is a cross-sectional explanatory view of an atomization device as a comparative example in which a relay absorber is not provided between the vibrating element and the liquid supply core. FIG. 6B is a cross-sectional explanatory view of the atomization device of the disclosure in which a relay absorber is added between the vibrating element and the liquid supply core.

On the basis of a comparative example and an example of the disclosure, a material of the liquid supply core 126 of FIGS. 6A and 6B is formed of, for example, only a polyester fiber bundle and does not contain an adhesive. Specifically, in a method for manufacturing the liquid supply core 126, for example, a plurality of thermoplastic polyester fibers is fused to each other, and the composition component of the liquid supply core 126 does not contain an adhesive. From a microscopic point of view, the liquid supply core is formed of only a plurality of polyester fiber bundles that is almost straight and extend uniaxially, and an extending length of each polyester fiber bundle ranges from the liquid absorbing end 126S to the atomizing end 126A. With such a configuration, it is possible to secure a flow direction of the liquid in the liquid supply core such that the flow direction is set along one axis in a fiber length direction. Therefore, as compared with a felt of the related art, the atomization device of the comparative example and the example of the disclosure can further improve the liquid absorption performance using the liquid supply core formed of only the polyester fiber bundle, and thus the liquid can be more stably supplied to the vibrating device 200. Further, in FIGS. 6A and 6B, the mesh plate 232 of the vibrating element 230 vibrates up and down by the piezoelectric element 234 being resonated (for example, 115 kHz) with an applied voltage, and when the mesh plate 232 is displaced, the supplied liquid is sprayed through the micropores of the mesh plate.

In the comparative example of FIG. 6A and the example of FIG. 6B, the liquid (for example, water) in the liquid supply tank 122 is sucked through capillaries of the fibers constituting the liquid supply core 126 using a capillary phenomenon. Next, the sucked water is provided between the relay absorber 260 and the vibrating element 230 via the atomizing end 126A of the liquid supply core 126. In the comparative example of FIG. 6A, any other solid member is not present between the liquid supply core 126 and the vibrating element 230, but in the example of FIG. 6B, the relay absorber 260 is present between the liquid supply core 126 and the vibrating element 230.

A difference between the comparative example of FIG. 6A and the example of FIG. 6B will be compared in detail.

In the comparative example of FIG. 6A, a gap G of about 0.2 mm to 0.3 mm is present between the liquid supply core 126 and the mesh plate 232. Since the mesh plate 232 of the vibrating element 230 generates unstable airflow and pressure when vibrating and displaced, these unstable airflow and pressure cause the airflow in the cavity part to fluctuate. Therefore, in the comparative example of FIG. 6A, even if a fiber bundle of which a flow direction is set uniaxially is used as the liquid supply core, the air and pressure existing in the gap G still have an influence, and a sufficient amount of water cannot be stably supplied in the gap G. Therefore, the atomization device as a comparative example of FIG. 6A causes phenomena such as a small spray amount, uneven spray, and inability to stably spray.

On the other hand, in the embodiment of FIG. 6B, the relay absorber 260 is installed between the vibrating element 230 and the atomizing end 126A of the liquid supply core 126. Specifically, the relay absorber 260 has both flexibility and water absorption, can be deformed according to the shape of the dome part 232D (inside the dome of the mesh plate), and can substantially fill the gap between the vibrating element 230 and the liquid supply core 126, and thus the liquid, for example, the water, absorbed in the liquid supply core 126 is efficiently transferred to the vibrating element 230 through the relay absorber 260. Further, the relay absorber 260 can be a buffer relay station having water retention, holding the liquid sucked up from the liquid supply core 126 in the relay absorber 260, and stably supplying the liquid to the vibrating element 230. Therefore, in the atomization device of the disclosure, by adding the relay absorber between the vibrating element and the liquid supply core, it is possible to realize an atomization device having both function of stably spraying and increasing the spray amount.

Further, since the relay absorber 260 has flexibility, the mesh plate 232 as an atomizing vibrating element is not mechanically loaded while the gap G is filled with the relay absorber 260. Therefore, it is possible to suppress a problem that the spray amount is reduced due to an operating load at the time of resonance of the mesh plate, and the spray amount is further stabilized. Further, from the viewpoint of assembly, the relay absorber 260 can also be used as a cushioning material. Therefore, it is possible to reduce the change in the contact state due to an error in assembling the liquid supply core, and it is possible to avoid a problem that the spray amount is reduced and the spray is not stable. The material of the relay absorber 260 can be a material having water absorption, chemical resistance, and flexibility. For example, the relay absorber 260 can be a flexible polyurethane sponge having an Asker C hardness of about 7.

Hereinafter, embodiments of the relay absorber will be described.

Figure 7A:
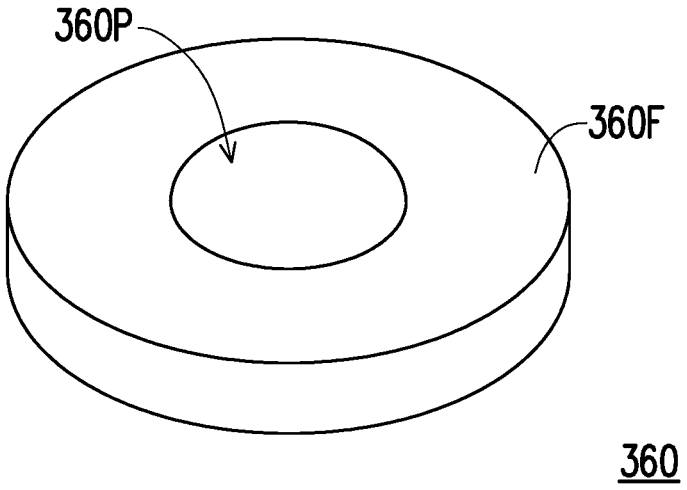
FIG. 7A is a perspective explanatory view of a relay absorber according to an embodiment of the disclosure.
Figure 7B:
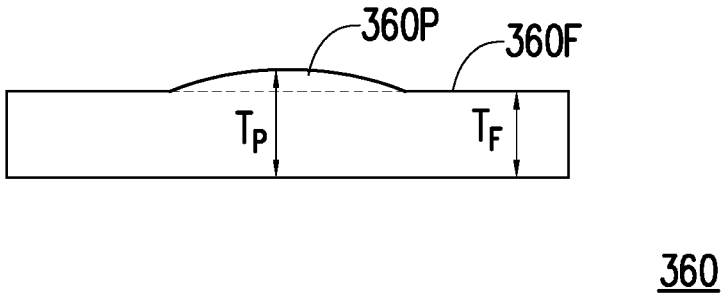
FIG. 7B is a cross-sectional explanatory view of the relay absorber according to the embodiment of the disclosure.

FIGS. 7A and 7B are a perspective explanatory view and a cross-sectional view of a relay absorber according to an embodiment of the disclosure. As shown in FIGS. 7A and 7B, in the present embodiment, a type of a relay absorber 360 can include a protrusion 360P located at a center and a peripheral flat portion 360F located around the protrusion 360P. A thickness $T_P$ of the protrusion 360P is thicker than a thickness $T_F$ of the peripheral flat portion 360F. The protrusion 360P is, for example, a portion arranged in the dome part 232D of the vibrating element 230 of FIG. 6B. In other words, an outer circumference of the protrusion 360P can largely overlap an outer circumference of the dome part 232D.

Figure 8A:
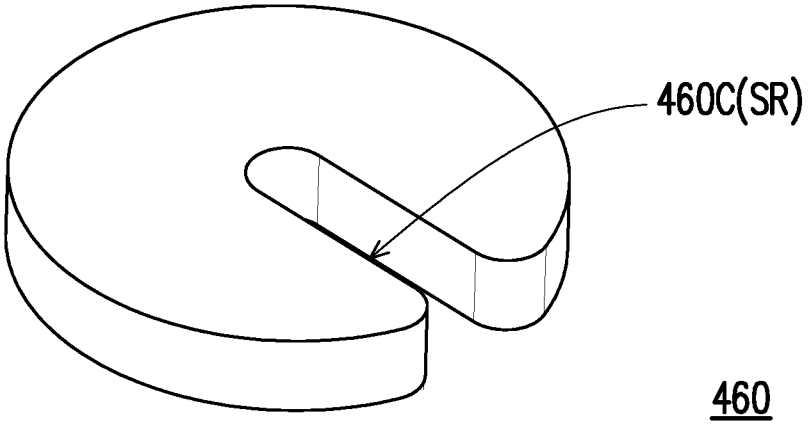
FIG. 8A is a perspective explanatory view of a relay absorber according to an embodiment of the disclosure.
Figure 8B:
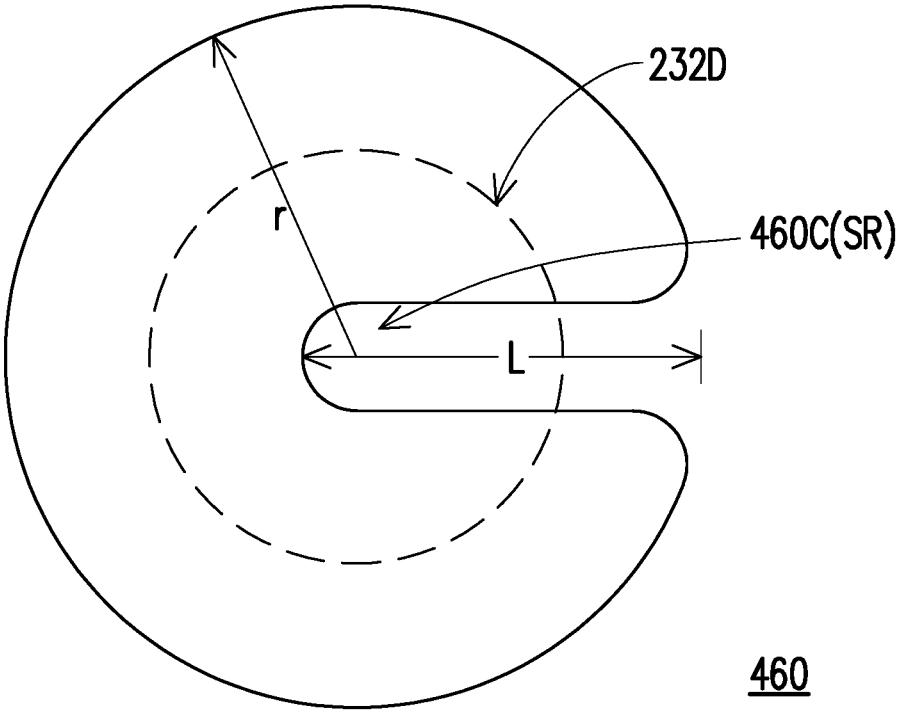
FIG. 8B is a top explanatory view of the relay absorber according to the embodiment of the disclosure.

In addition, the relay absorber can be in the following form. FIGS. 8A and 8B are a perspective explanatory view and a top view of a relay absorber according to an embodiment of the disclosure. As shown in FIGS. 8A and 8B, a relay absorber 460 can have a cut-out portion 460C. In the present application, the so-called cut-out portion in the relay absorber is a cut-out portion having a length larger than a radius of the dome part 232D and is essentially different from the porous material which contains pores in material. Further, a thickness of the relay absorber is preferably 1 mm or more, and in this way, more appropriate rigidity and hardness can be obtained. In the present embodiment, the relay absorber 460 has a cylindrical shape, and the cut-out portion 460C is, for example, a single radial slit SR. Such an embodiment is the same as the relay absorber 260 shown in FIGS. 3 and 5 described above.

In the embodiment of FIGS. 3, 5, 8A, and 8B, a part of the cut-out portion 460C communicates with the inside of the dome part 232D of the mesh plate 232. In order to clearly show a relative positional relationship between the dome part 232D of the vibrating element 230 and the cut-out portion 460C, a broken line in FIG. 8B indicates an outer peripheral position of the dome part 232D in an orthogonal projection direction in the Z direction and overlaps a range covered by the dome part 232D of the vibrating element 230 in the orthogonal projection direction of the radial slit SR. As shown in FIG. 8B, a length L of the radial slit SR is larger than a radius r of the relay absorber 460. In the present embodiment, the relay absorber 460 can perform the following functions by being provided with the cut-out portion 460C. That is, in a case where the relay absorber 460 sucks air during a vibration displacement of the mesh plate 232 of the vibrating device 200, bubbles and an air layer are generated between the relay absorber 460 and the mesh plate 232, and the spray becomes unstable. In such a case, by being provided with the cut-out portion 460C, the relay absorber 460 can appropriately discharge the bubbles and the air layer generated due to the resonance, and thus it is possible to further reduce or eliminate the decrease in the spray efficiency due to the bubbles.

Figure 8C:
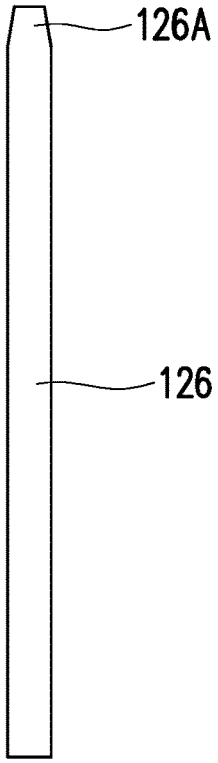
FIG. 8C is a side explanatory view of a liquid supply core according to an embodiment of the disclosure.
Figure 8D:
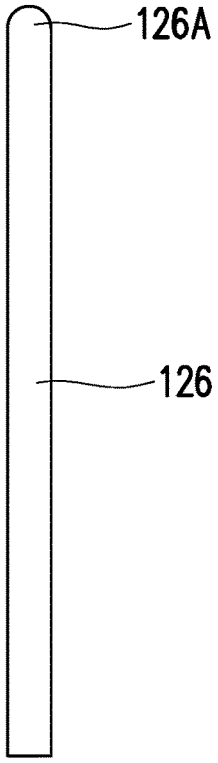
FIG. 8D is a side explanatory view of a liquid supply core according to an embodiment of the disclosure.

Further, in the present embodiment, even if the relay absorber 460 is not separately provided with the protrusion, the relay absorber 460 itself has flexibility, and thus the relay absorber 460 can be pushed into the dome part 232D by an upward contacting force of the liquid supply core 126. In one embodiment, as shown in FIG. 8C, a diameter of the atomizing end 126A of the liquid supply core 126 can be smaller than an outer diameter of a portion of the liquid supply core other than the atomizing end. Further, as shown in FIG. 8D, the atomizing end 126A of the liquid supply core 126 can also be provided in a spherical shape and can more easily push the relay absorber 460 into the dome part 232D.

Figure 9A:
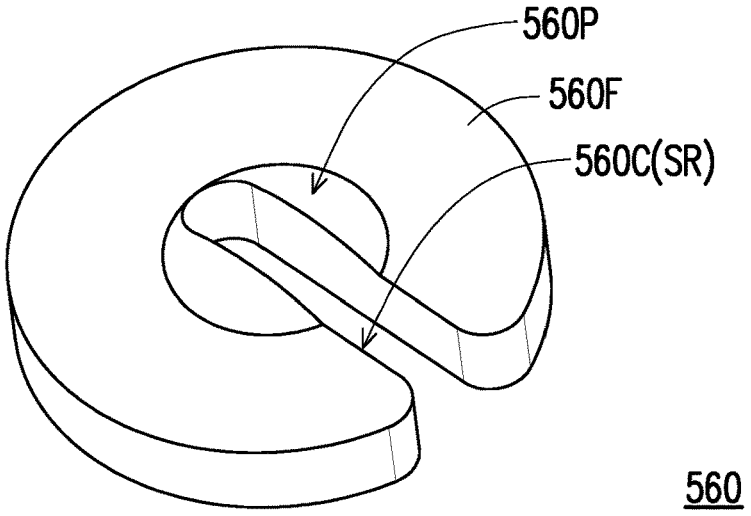
FIG. 9A is a perspective explanatory view of a relay absorber according to an embodiment of the disclosure.
Figure 9B:
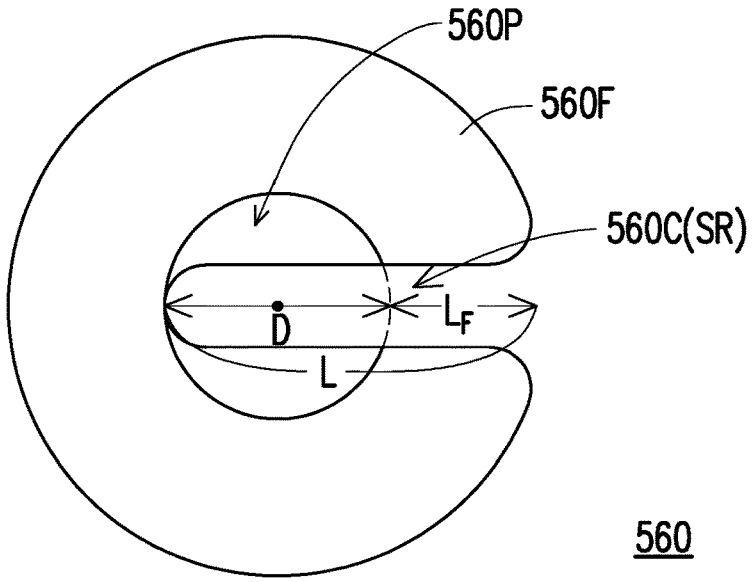
FIG. 9B is a top view of the relay absorber according to the embodiment of the disclosure.
Figure 9C:
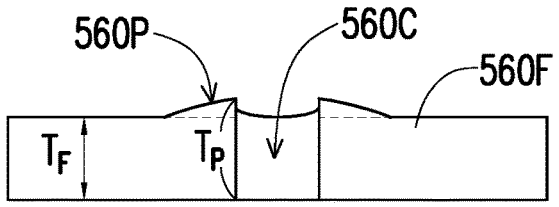
FIG. 9C is a cross-sectional view of the relay absorber according to the embodiment of the disclosure.

FIGS. 9A to 9C are a perspective explanatory view, a top view, and a cross-sectional view of a relay absorber according to an embodiment of the disclosure. A relay absorber 560 of the present embodiment is provided with a protrusion 560P at a center of the relay absorber 460 described above. As shown in FIGS. 9A to 9C, the relay absorber 560 includes the protrusion 560P located at a center and a peripheral flat portion 560F located around the protrusion 560P. A thickness $T_P$ of the protrusion 560P is thicker than a thickness $T_F$ of the peripheral flat portion 560F. A cut-out portion 560C is, for example, a single radial slit SR. In a coupled state, with reference to FIGS. 3, 5, and 9A to 9C, the protrusion 560P is arranged in the dome part 232D of the vibrating element 230. In other words, an outer circumference of the protrusion 560P can largely overlap an outer circumference of the dome part 232D. In the present embodiment, a length L of the cut-out portion 560C is, in most cases, the sum of a length $L_F$ of the peripheral flat portion 560F and a diameter D of the protrusion 560P.

Figure 10A:
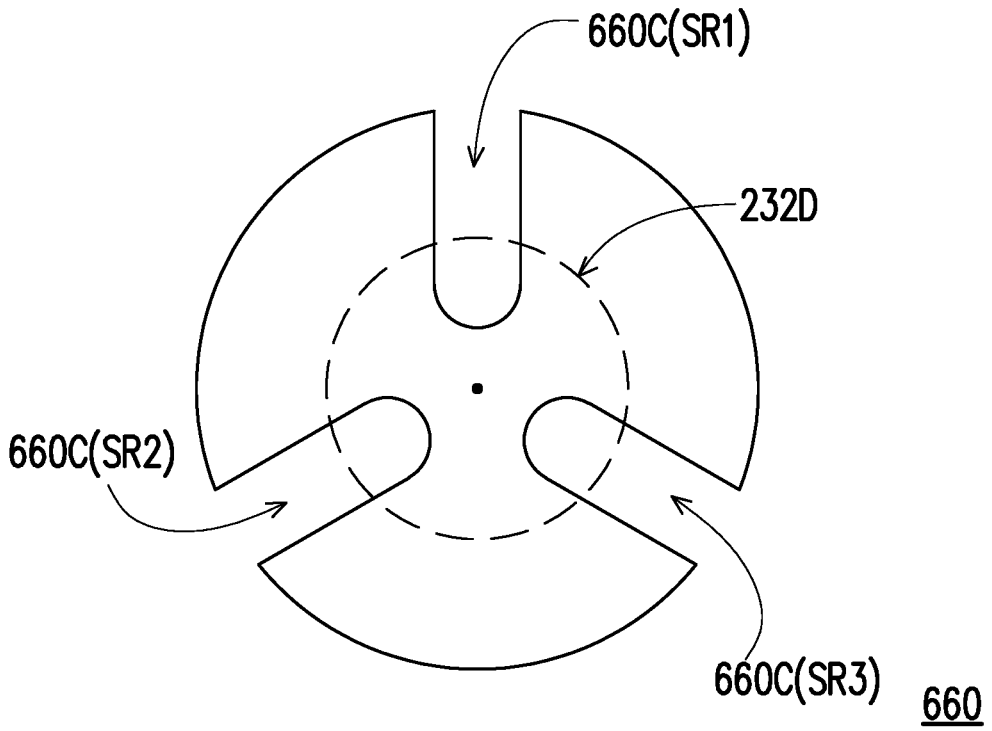
FIG. 10A is a top view of a relay absorber according to an embodiment of the disclosure.

FIG. 10A is a top view of a relay absorber according to an embodiment of the disclosure. In the present embodiment, a cut-out portion 660C of a relay absorber 660 includes a plurality of radial slits SR1 to SR3, and an extending direction of each of the radial slits SR1 to SR3 extends from a center of a circle to an outer circumference. As shown in FIG. 10A, in the top view (that is, in an orthographic projection direction in a thickness direction of the relay absorber), the plurality of radial slits SR1 to SR3 is radial in the relay absorber. Further, in the orthographic projection direction of the radial slits SR, the radial slits SR overlap the range covered with the dome part 232D as shown in FIG. 6B. Since the relay absorber 660 is provided with the cut-out portion 660C that allows air to escape from the dome part 232D, the relay absorber 660 can appropriately discharge unstable bubbles generated during a vibration, thereby stabilizing the spray.

Figure 10B:
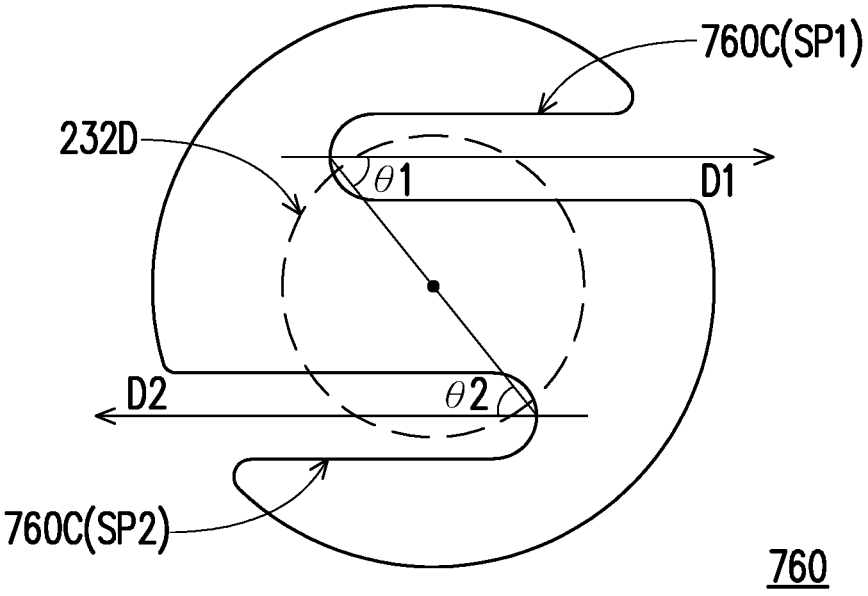
FIG. 10B is a top view of a relay absorber according to an embodiment of the disclosure.

FIG. 10B is a top view of a relay absorber according to an embodiment of the disclosure. As shown in FIG. 10B, a cut-out portion 760C of a relay absorber 760 includes a plurality of parallel slits SP1 and SP2, and the plurality of parallel slits SP1 and SP2 is disposed in a staggered pattern to be point-symmetrical with respect to a center of a circle of the relay absorber 760. For example, extending directions D1 and D2 of the parallel slits SP1 and SP2 extend from the inside to the outside of the relay absorber 760. As shown in FIG. 10B, the extending directions D1 and the extending direction D2 are parallel to each other, and an angle θ1 between the extending direction D1 and the center of the circle of the relay absorber 760 is equal to an angle θ2 between the extending direction D2 and the center of the circle of the relay absorber 760. In the present embodiment, in the orthogonal projection direction of the parallel slits SP1 and SP2, the parallel slits SR overlap the range covered with the dome part 232D as shown in FIG. 6B. Since the relay absorber 760 is provided with the cut-out portion 760C that allows air to escape from the dome part 232D, the relay absorber 760 can appropriately discharge unstable bubbles generated during a vibration, thereby stabilizing the spray.

In the atomization device of the disclosure, a waterproof structure can be further provided at an appropriate seam of the atomization device, and waterproof performance can be provided while maintaining spray efficiency. Further, the vibrating device and the support rod of the atomization device are further provided with an exhaust structure, and thus stable spray efficiency can be realized while maintaining the spray efficiency.

In the following, a waterproof mechanism and an exhaust mechanism of the atomization device of the disclosure will be further described.

Figure 11A:
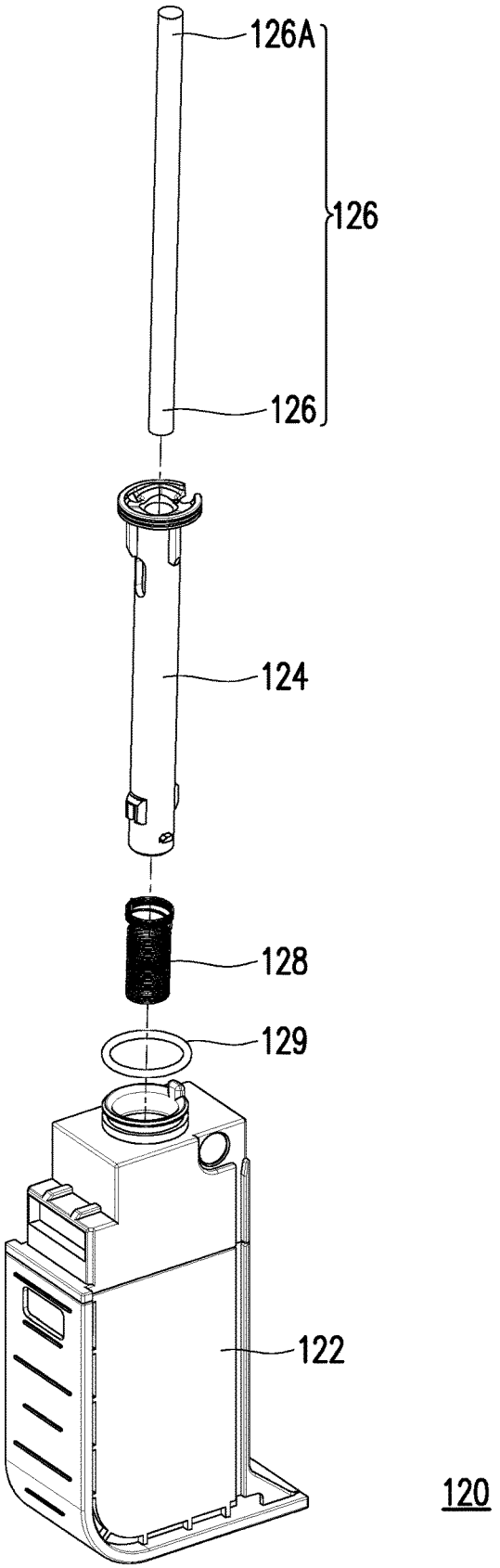
FIG. 11A is an exploded explanatory view of a tank assembly according to an embodiment of the disclosure.
Figure 11B:
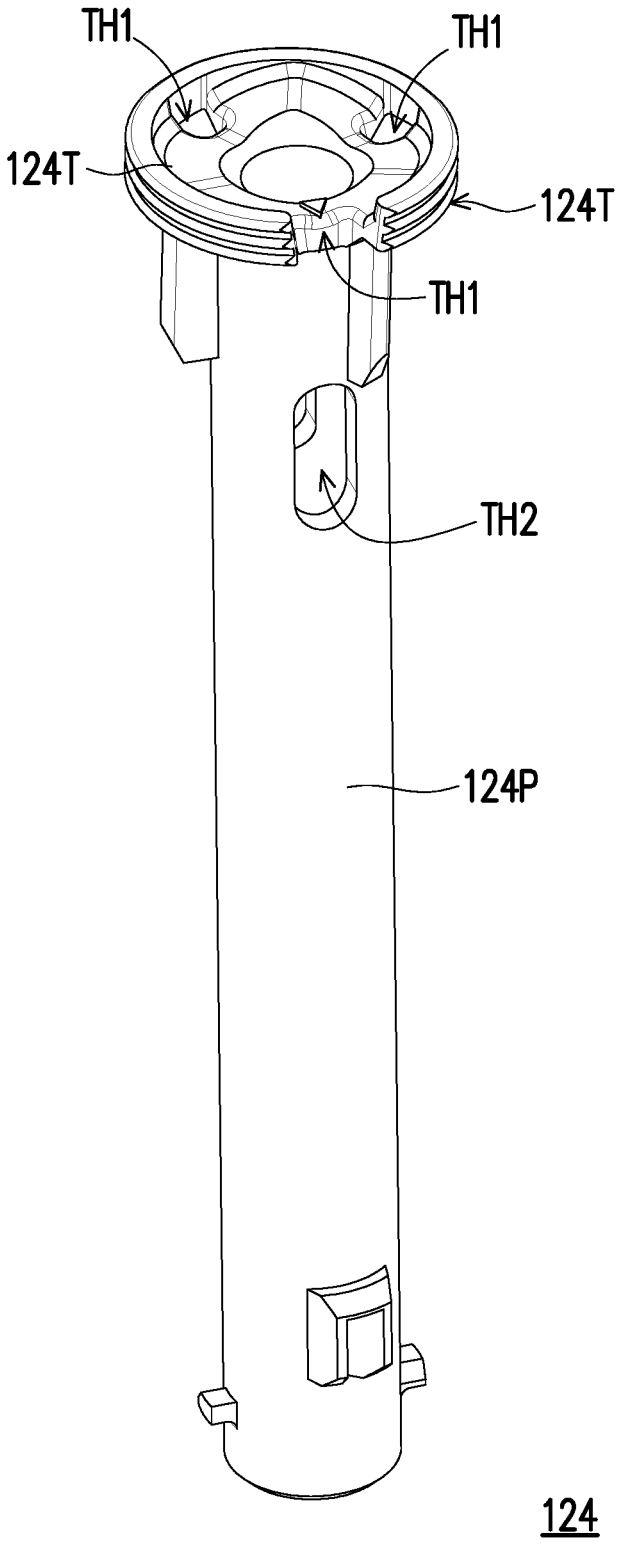
FIG. 11B is a perspective explanatory view of a support rod according to an embodiment of the disclosure.

FIG. 11A is an exploded explanatory view of a tank assembly according to an embodiment of the disclosure, and FIG. 11B is an explanatory view of a support rod according to an embodiment of the disclosure. With reference to FIGS. 11A and 11B, the tank assembly 120 includes a liquid supply tank 122, a support rod 124, and a liquid supply core 126, and in the present embodiment, the tank assembly 120 has further includes an elastic member 128 for causing the liquid supply core 126 to come into contact with the vibrating element 230 of the vibrating device 200 upwardly. The elastic member 128 is, for example, one spring member having two different diameters and formed of winding portions that are in close contact with each other. A lower end of the spring member having a small diameter is formed of, for example, a spiral portion. The spiral portion acts to urge the liquid supply core 126 with a constant force by using a restoring force of a spring. The liquid supply core 126 is tightly sandwiched between the spiral portion and the vibrating device 200. With this configuration, the liquid in the liquid supply tank 122 can be stably supplied to the vibrating device 200. Further, the assembly of the present embodiment further includes a sealing member 129 disposed between the support rod 124 and the liquid supply tank 122 and can have waterproof performance while maintaining the spray efficiency.

Further, a specific form of the support rod 124 can be shown in FIG. 11B, and the support rod 124 includes a connection upper part 124T and a pipe part 124P. The connection upper part 124T is connected to the above-mentioned vibrating device 200. The liquid supply core 126 is accommodated inside the pipe part 124P. A first through hole TH1 can be provided at an appropriate location on the connection upper part 124T, and in the present embodiment, three first through holes TH1 are provided. The pipe part 124P has a second through hole TH2 in a side wall thereof, and the first through hole TH1 and the second through hole TH2 communicate with the outside air. The setting positions of the first through hole TH1 and the second through hole TH2 are as described later.

Figure 12A:
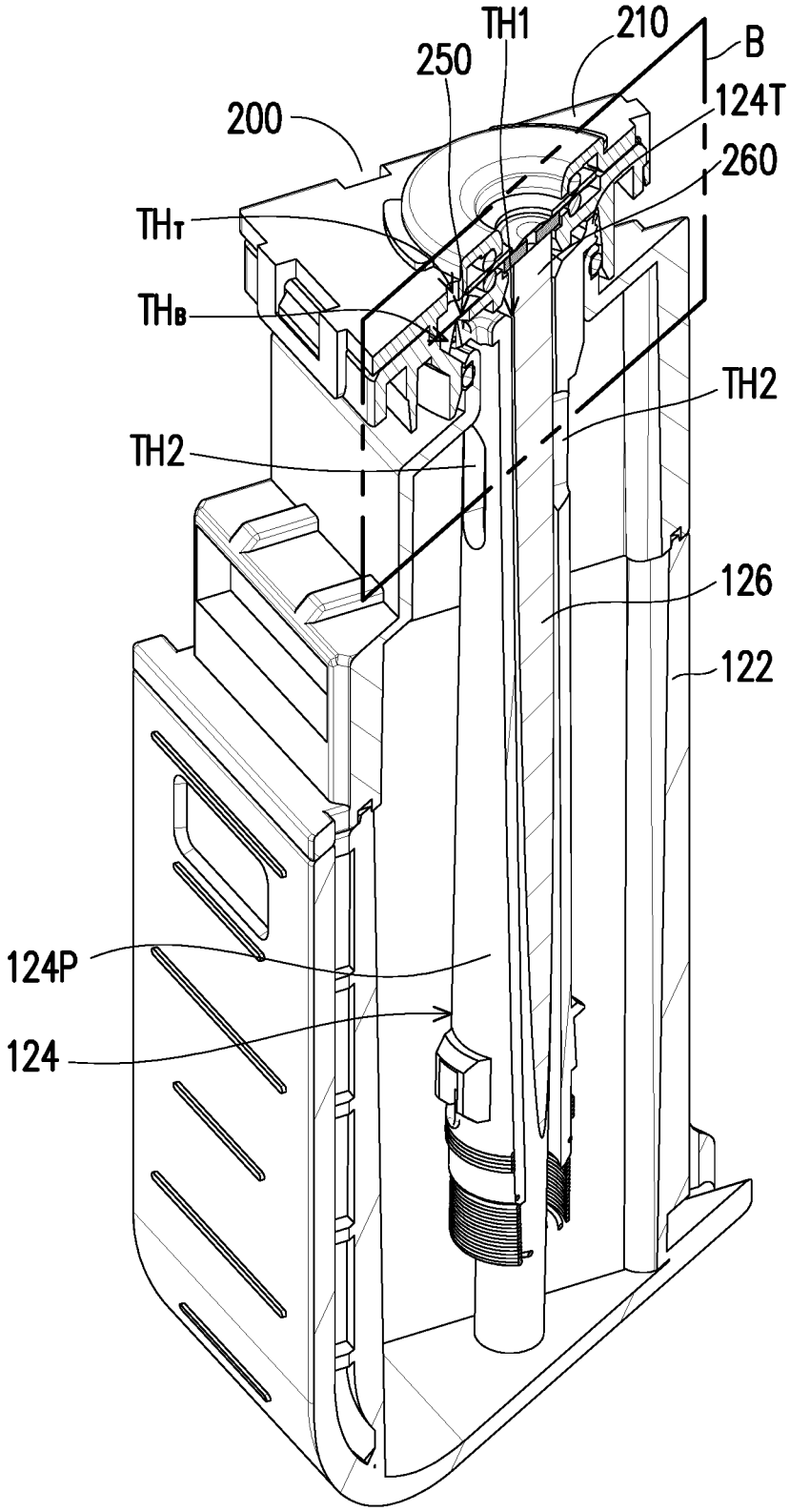
FIG. 12A is a cross-sectional explanatory view cut from a vent hole portion according to an embodiment of the disclosure.
Figure 12B:
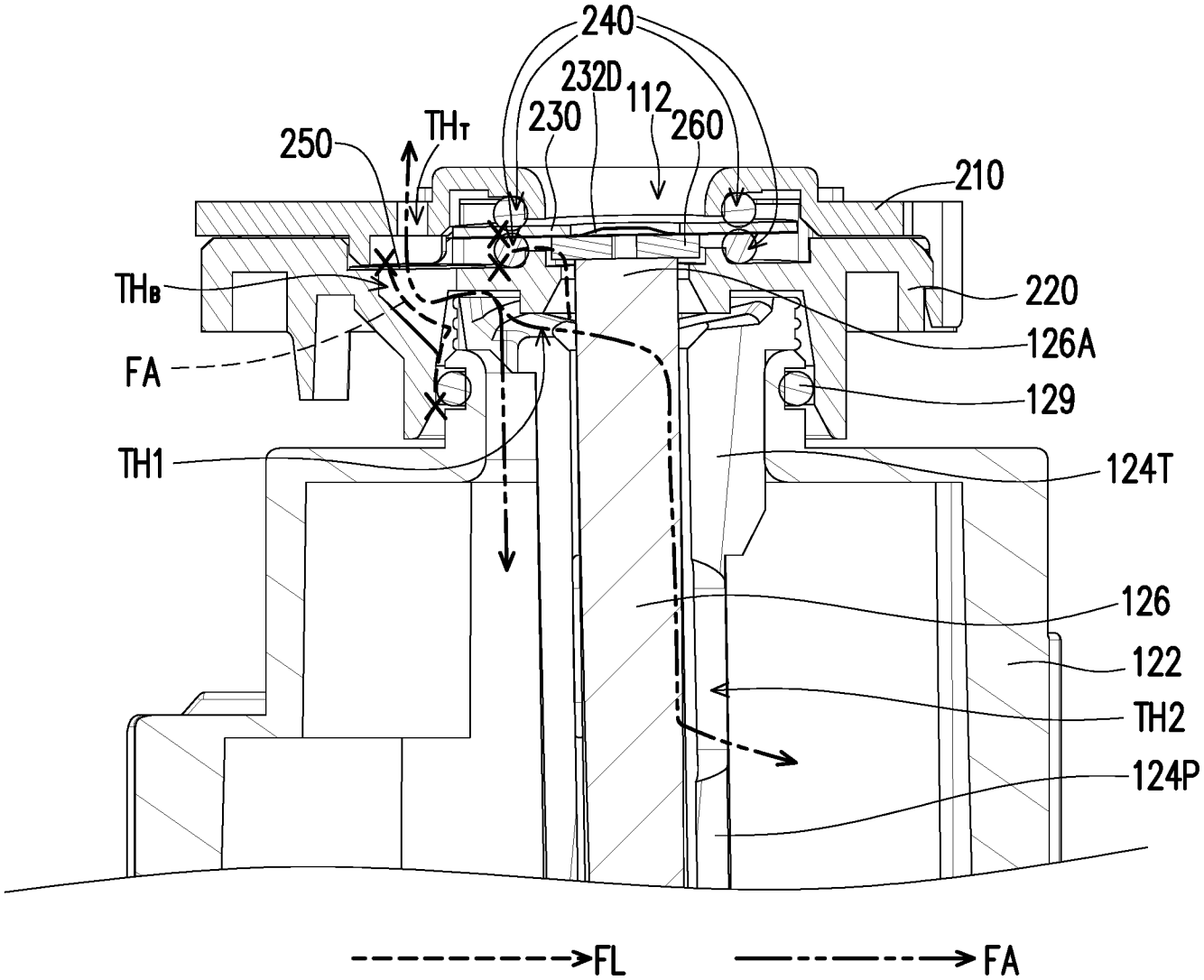
FIG. 12B is an enlarged cross-sectional explanatory view of a portion B in FIG. 12A.

FIG. 12A is a cross-sectional explanatory view cut from a vent hole portion according to an embodiment of the disclosure, and FIG. 12B is an enlarged cross-sectional explanatory view of a portion B of FIG. 12A. With reference to FIGS. 12A and 12B, in addition to the internal pressure adjusting sheet 250 being provided between the upper lid 210 and the base 220 of the vibrating device 200 as shown in FIG. 3 described above, in the present embodiment, the upper lid 210 and the base 220 each have an upper through hole $TH_T$ and a lower through hole $TH_B$, and the internal pressure adjusting sheet 250 is disposed between the upper through hole $TH_T$ and the lower through hole $TH_B$, thereby allowing only gas to pass through and not allowing liquid to pass through. The upper through hole $TH_T$ and the lower through hole $TH_B$ communicate with the outside air.

Further, the connection upper part 124T of the support rod 124 has the first through hole TH1. The first through hole TH1, the upper through hole $TH_T$, and the lower through hole $TH_B$ communicate with each other in a coupled state and form one exhaust passage communicating with the outside air, which is an air flow path FA passing through the internal pressure adjusting sheet 250 in the figure. Further, the pipe part 124P has the second through hole TH2 that can communicate with the outside air in the side wall and discharges air to the outside, which is an air flow path FA passing through the second through hole TH2 in the figure. By being provided with the first through hole TH1 and the second through hole TH2, the atomization device can timely release the internal pressure to the outside when the internal pressure is high. Therefore, in the atomization device of the disclosure, when the internal pressure fluctuation of the liquid supply tank becomes a positive pressure or the external pressure becomes high, the above exhaust configuration causes air to overflow from the inside of the apparatus to the outside. Therefore, a pressure difference between the inside and the outside of the atomization device can be balanced and the spray can be made more stable.

On the other hand, as shown in FIG. 12B, the atomization device of the disclosure can prevent water from seeping out from the micropores of the mesh plate with the waterproof configuration, for example, a structure of the sealing member 240 installed in the vibrating device and the sealing member 129 installed between the liquid supply tank 122 and the support rod 124, as a water flow path FL in FIG. 12B.

Figure 13A:
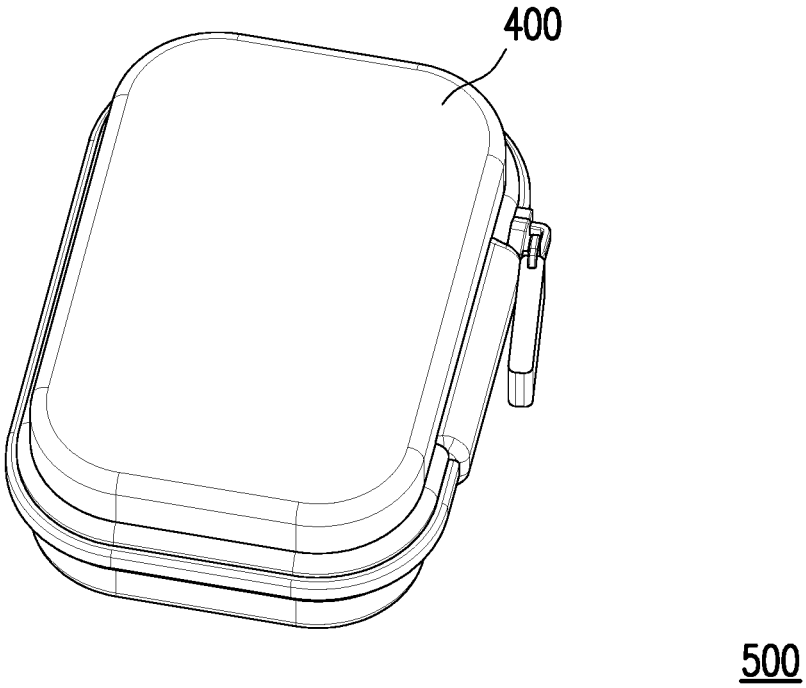
FIG. 13A is an explanatory view of an atomization device assembly according to an embodiment of the disclosure.
Figure 13B:
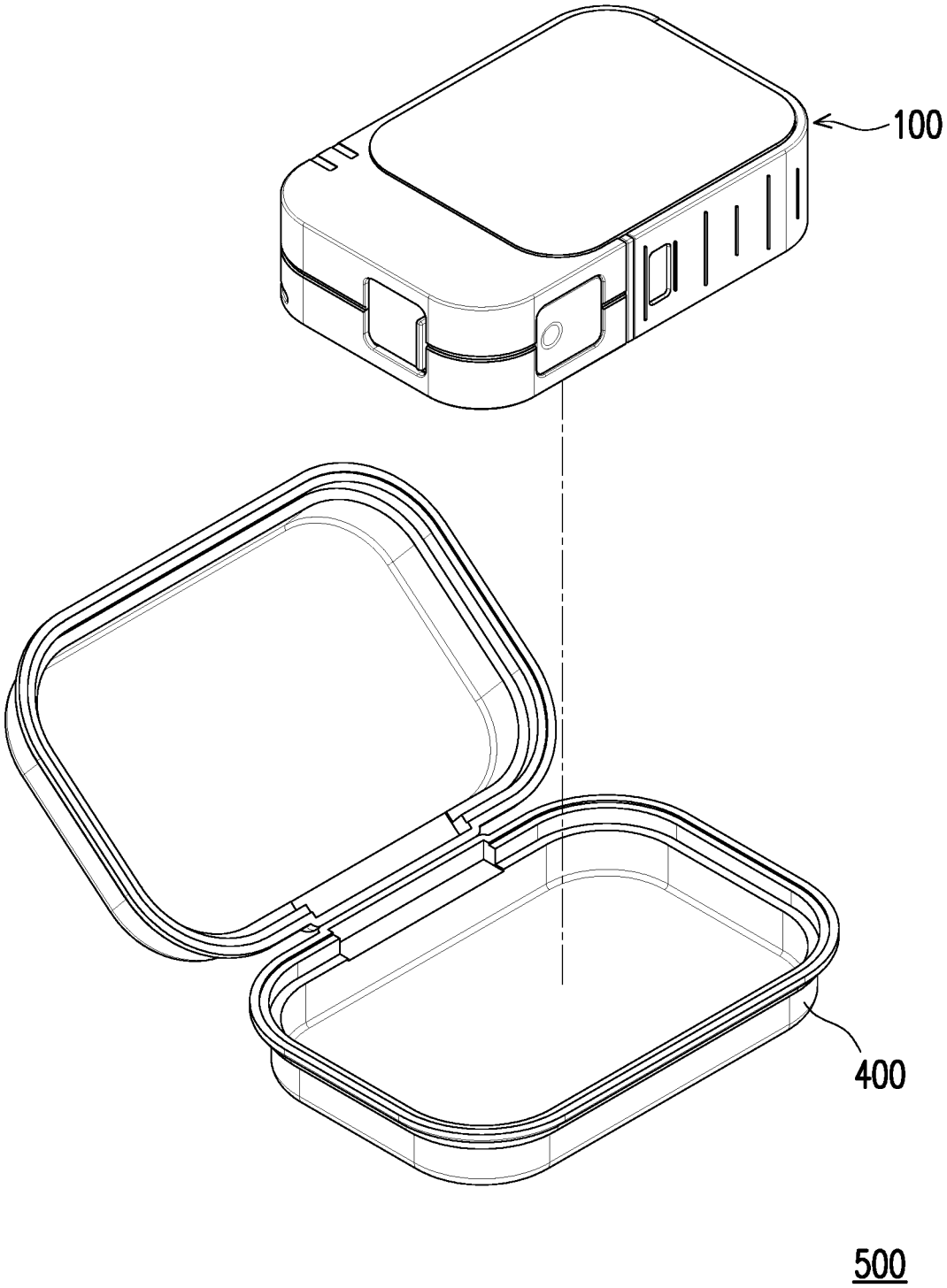
FIG. 13B is an explanatory view of the atomization device assembly according to the embodiment of the disclosure.

FIGS. 13A and 13B are explanatory views of an atomization device assembly according to an embodiment of the disclosure. As shown in FIGS. 13A and 13B, the atomization device 100 described above can be further disposed in a waterproof case 400 to form an atomization device assembly 500. The waterproof case 400 has water leakage prevention performance and shock absorption performance and thus reduces the risk of water leakage, and prevents water from seeping out from the mesh plate due to a vibration, an impact, and an external pressure when the atomization device 100 is carried. Therefore, seeping out, leaking, and scattering of the water in the atomization device 100 is avoided.

The disclosure further provides a control system for atomization device that can detect a drive voltage, a drive current, or the like of the vibrating element and can determine whether the water supply condition is good, and thus can cause the user to timely perform an appropriate operation, for example, replenishing a liquid.

Figure 14:
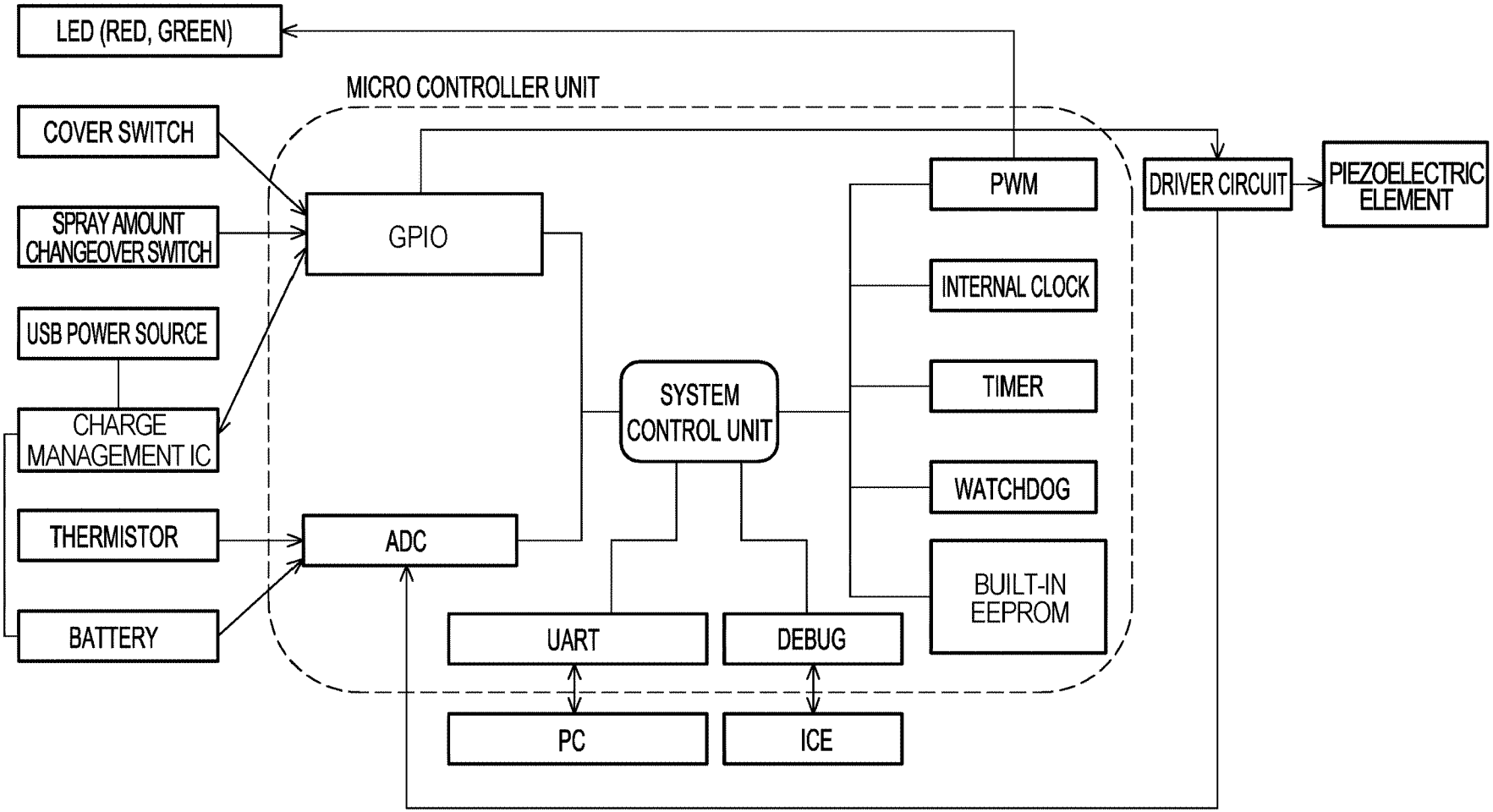
FIG. 14 is a configuration diagram of a control system for an atomization device of the disclosure.

FIG. 14 is a configuration diagram of a control system for an atomization device of the disclosure. With reference to FIG. 14, a driver circuit of the control system of the atomization device is used to drive the vibrating element by receiving an output signal from a micro controller unit (MCU).

Specifically, as shown in FIG. 14, the control system is integrated into the driver circuit of the atomization device. The driver circuit processes and integrates information between the micro controller unit installed in the atomization device and the external member. In particular, the driver circuit is also used to detect a change in impedance of the piezoelectric element.

Specifically, as an example, as shown in FIG. 14, the micro controller unit provided in the atomization device includes a system control unit, and a general purpose input output (GPIO), an analog-to-digital converter (AD converter), a universal asynchronous receiver/transmitter (UART), a Debug, a built-in electrically erasable programmable read-only memory (EEPROM), a watchdog, a timer, an internal clock, and a pulse width modulation (PWM), which are electrically connected to the system control unit. The configuration for controlling the atomization device is not limited to this as long as the above-mentioned so-called CPU, input/output, and control unit can be realized.

As shown in FIG. 14, members electrically connected to external information are provided outside the micro controller unit. The members are, for example, LEDs, a cover switch, a spray amount changeover switch, a USB power source, a battery, a charge management IC (charger IC), a thermistor, and the like. The charge management IC properly manages a charging voltage and a charging current when the battery is charged with electricity supplied from the USB power source, and a product generally sold in an integrated circuit (IC) package can be used as the charge management IC. The LEDs can display green G and red R to inform the user if the atomization device is ready for use. The cover switch, the spray amount changeover switch, and the charge management IC are electrically connected to the GPIO, and among them, the charge management IC is electrically connected to the USB power source and the battery. The thermistor and the battery are electrically connected to the AD converter and detect a battery temperature of the atomization device and the like. In the present embodiment, the UART is electrically connected to a PC of the external member. The Debug is electrically connected to an in-circuit emulator (ICE) of the external member. In other embodiments, the PC of the present embodiment can be omitted, and the disclosure is not limited thereto.

In particular, the control system of the disclosure further includes a driver circuit electrically connected to the piezoelectric element. Since the control system is provided with the driver circuit for the piezoelectric element, the control system detects a change in impedance of the vibrating element and determines whether or not the water is present in the relay absorber and the tank. The driver circuit drives the piezoelectric element and monitors a drive voltage and a drive current of the piezoelectric element during operation.

Specifically, the driver circuit includes a drive voltage monitor for monitoring the drive voltage of the piezoelectric element and a current monitor for monitoring the drive current of the piezoelectric element. The driver circuit detects a change in the impedance of the piezoelectric element in the vibrating element on the basis of the drive voltage and the drive current. The piezoelectric element that feeds back the change to a piezoelectric element impedance detector of the micro controller unit is, for example, a sensor based on a piezoelectric effect. As shown in FIG. 4 described above, in the vibrating element of the disclosure, a peripheral portion thereof is the piezoelectric element 234, the piezoelectric element 234 is made of a piezoelectric material, and the piezoelectric material generates an electric charge on a surface thereof after receiving a force. In this way, an operating state of the vibrating element such as the drive voltage and drive current can be detected, and the operating state can be converted into the force received by the piezoelectric element 234. As a result, the pressure inside the dome part of the vibrating element can be reflected, the amount of liquid sucked up by the relay absorber can be determined, and whether the remaining amount of the liquid in the liquid supply tank is sufficient can be estimated.

In one detection method of the present embodiment, the change in impedance of the piezoelectric element can be an aspect of the following embodiment. That is, the change in impedance in an anhydrous state is set as a reference impedance, and then, when a real-time impedance converted using the drive voltage and the drive current monitored by the driver circuit is lower than the reference impedance, this signal is fed back to the micro controller unit with the drive voltage. At this time, the atomization device can emit a spray stop signal to stop the spray, or the atomization device can notify the user of a warning signal by issuing a warning sound, turning on or blinking an external lamp, or the like.

Figure 15:
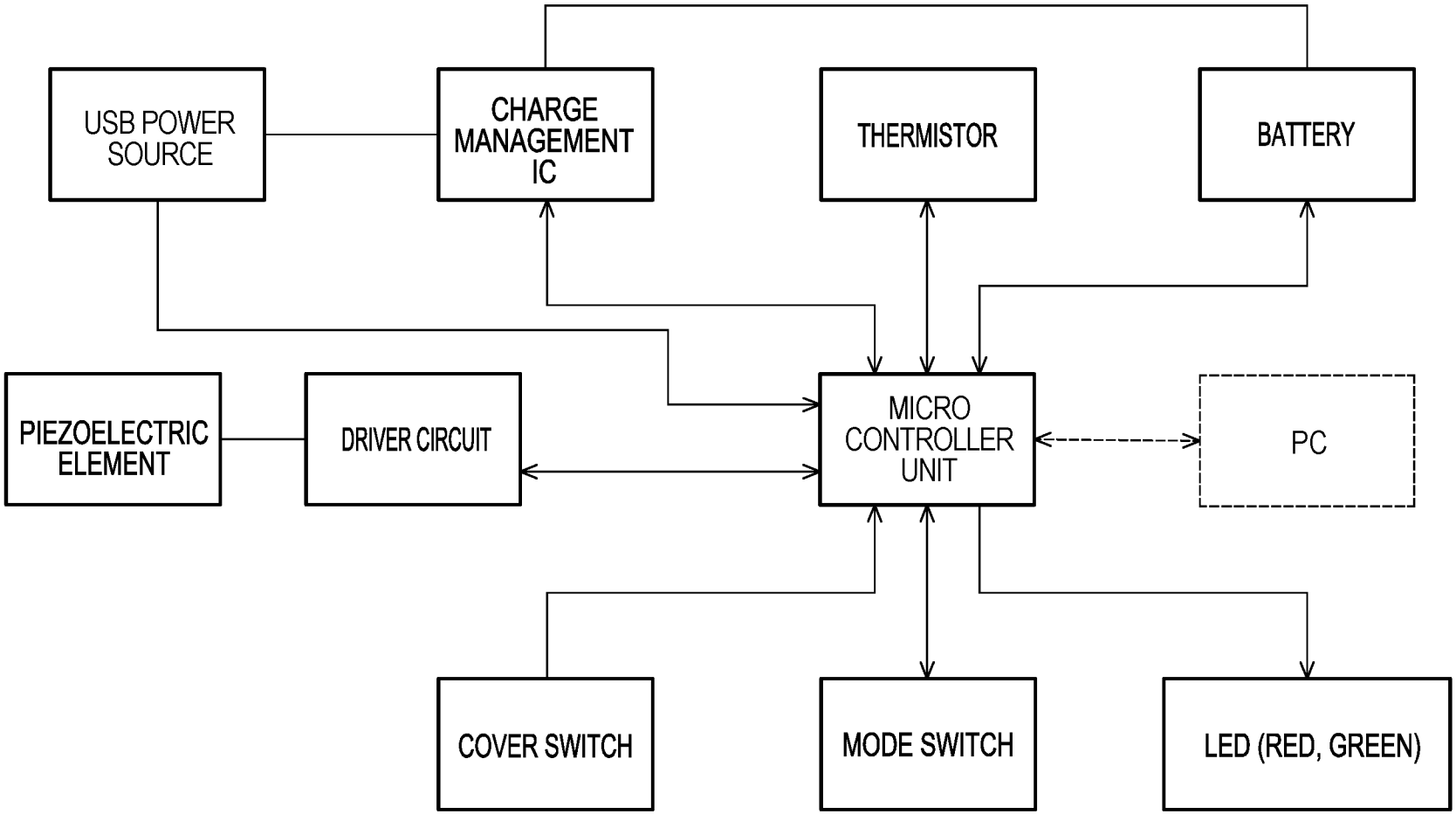
FIG. 15 is an explanatory diagram of a detection signal of the control system for an atomization device of the disclosure.

Specifically, FIG. 15 is an explanatory diagram of a detection signal of the control system for an atomization device of the disclosure. With reference to FIG. 15, the driver circuit performs signal transmission using the MCU and the units shown in FIG. 14 described above and in particular, is electrically connected to the piezoelectric element. As shown in FIG. 15, the vibrating device and the driver circuit are configured to be able to detect the change in impedance of the piezoelectric element 234.

Further, in the embodiment of the atomization device in which the relay absorber of the disclosure has the cut-out portion, the driver circuit can detect the change in impedance in different regions of the piezoelectric element 234 of the vibrating element 230, and thus an immediate change in liquid content of the liquid supply core is effectively reflected. In this way, the remaining liquid in the liquid supply tank can be detected immediately.

Specifically, in the detection method of such an embodiment, a contact portion between the dome part of the mesh plate and the relay absorber can be divided into two different states, that is, an air layer and a liquid layer. For example, a contact portion between the dome part and the cut-out portion is an air-containing layer, and its impedance can be set as a reference impedance. On the other hand, the contact portion between the dome part and the relay absorber excluding the cut-out portion is a liquid-containing layer, and its impedance is a real-time impedance. The driver circuit can detect the change in impedance between the air-containing layer and the liquid-containing layer in real time.

Specifically, even if the vibrating element raises the real-time impedance with the pressure existing in the dome part, the reference impedance rises in synchronization with the pressure existing inside, and thus a difference value between the real-time impedance and the reference impedance is relatively unaffected by the pressure inside the dome part. In this way, the driver circuit can detect the difference value between the reference impedance and the real-time impedance in real time, can more accurately determine whether the water supply state in the apparatus is preferable, can feed back the determination result to the micro controller unit in real time, and can cause the user to perform an appropriate operation, for example, replenishment of the liquid, immediately and accurately.

Therefore, on the basis of the above, according to the atomization device of the disclosure, it is possible to realize an atomization device that has both functions of stably spraying and increasing the spray amount. In addition, the specific structure that can be appropriately exhausted can reduce or eliminate the decrease in spray efficiency due to the air bubbles and further increase the usage rate of the liquid. Further, the specific waterproof structure can further provide waterproof performance. According to the atomization device assembly of the disclosure, it is possible to avoid a situation in which the water seeps out, leaks, or scatters in the atomization device. According to the control system for an atomization device of the disclosure, it is possible to accurately determine whether the spray state and the water supply state are preferable and to cause the user to perform an appropriate operation in real time and accurately.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An atomization device comprising:

a main body that has a vibrating device and a cavity part and in which the vibrating device is disposed above the cavity part and includes a vibrating element; and a tank assembly that is detachably provided with respect to the main body and is accommodated in the cavity part in a coupled state of being attached to the main body, wherein the tank assembly comprises:

a liquid supply tank that has a space to hold a liquid, and a liquid supply core that supplies the liquid in the liquid supply tank to one side of the vibrating device, and wherein the atomization device further comprises:

a relay absorber disposed between the vibrating element and the liquid supply core, wherein the vibrating element comprises a mesh plate located in a central portion and a piezoelectric element located in a peripheral portion, the mesh plate has a dome part at a center of the vibrating element, and a part of the relay absorber is disposed in the dome part of the mesh plate, the relay absorber has a cut-out portion, and a part of the cut-out portion communicates with an inside of the dome part of the mesh plate, the relay absorber is deformable according to a shape of the dome part and substantially fills a gap between the vibrating element and the liquid supply core.

2. The atomization device according to claim 1, wherein the cut-out portion comprises a radial slit, and at least a part of the radial slit overlaps the dome part in an orthographic projection direction.

3. The atomization device according to claim 2, wherein single one radial slit is provided, and a length of the radial slit is larger than a radius of the relay absorber.

4. The atomization device according to claim 2, wherein a plurality of the radial slits are provided, and the plurality of radial slits are radial in an orthographic projection direction of the relay absorber.

5. The atomization device according to claim 1, wherein the cut-out portion comprises a plurality of parallel slits, and in an orthographic projection direction of the relay absorber, the plurality of parallel slits are disposed in a staggered pattern to be point-symmetrical with respect to a center of a circle of the relay absorber.

6. The atomization device according to claim 1, wherein the relay absorber comprises a protrusion located at a center and a peripheral flat portion located around the protrusion, a thickness of the protrusion is thicker than that of the peripheral flat portion, and the protrusion is disposed within the dome part.

7. The atomization device according to claim 6, wherein a length of the cut-out portion is a sum of a length of the peripheral flat portion and a diameter of the protrusion.

8. The atomization device according to claim 1, wherein the liquid supply core has a liquid absorbing end and an atomizing end, and a diameter of the atomizing end of the liquid supply core is smaller than an outer diameter of a portion of the liquid supply core other than the atomizing end.

9. The atomization device according to claim 8, wherein the atomizing end of the liquid supply core has a spherical shape.

10. The atomization device according to claim 1, wherein the vibrating device further comprises:

an upper lid, a base, and an internal pressure adjusting sheet installed between the upper lid and the base, and wherein the vibrating element is installed between the upper lid and the base, and the liquid is atomized by the vibrating element.

11. The atomization device according to claim 10, wherein each of the upper lid and the base has an upper through hole and a lower through hole, and the upper through hole and the lower through hole communicate with an outside air.

12. The atomization device according to claim 10, wherein the vibrating device further comprises a plurality of sealing members respectively disposed between the vibrating element and the upper lid and between the vibrating element and the base.

13. The atomization device according to claim 1, wherein the tank assembly further comprises a support rod, the support rod is installed in the liquid supply tank, and in the coupled state, the support rod is connected to the vibrating device, the liquid supply core has a liquid absorbing end and an atomizing end, and the relay absorber is disposed between the vibrating element and the atomizing end of the liquid supply core.

14. The atomization device according to claim 13, wherein the tank assembly further comprises a sealing member disposed between the support rod and the liquid supply tank.

15. The atomization device according to claim 13, wherein the support rod comprises:

a connection upper part that is connected to the vibrating device, and a pipe part that accommodates the liquid supply core, and wherein the connection upper part has a first through hole, the pipe part has a second through hole in a side wall of the pipe part, and the first through hole and the second through hole communicate with an outside air.

16. The atomization device according to claim 1, wherein a material of the relay absorber consists of polyurethane.

17. The atomization device according to claim 1, wherein the main body comprises a case and a lid locking mechanism disposed on the case, and the lid locking mechanism is provided to be movable with respect to the case and has a closed state where an ejection port of the vibrating device is closed and an open state where the ejection port of the vibrating device is exposed.

18. An atomization device assembly comprising:

the atomization device according to claim 1; and a waterproof case, wherein the atomization device is disposed in the waterproof case.

19. A control system for an atomization device for controlling the atomization device according to claim 1, the control system comprising:

a micro controller unit that controls the vibrating device of the atomization device and atomizes the liquid flowing from the liquid supply core to the relay absorber with a vibration of the vibrating element; and a driver circuit that monitors a drive voltage and a drive current of the piezoelectric element, wherein the driver circuit detects a change in impedance of the piezoelectric element on the basis of the drive voltage and the drive current and feeds back the change to the micro controller unit.

* * * * *